US007578079B2

(12) United States Patent
Furem

(10) Patent No.: US 7,578,079 B2
(45) **Date of Patent: *Aug. 25, 2009**

(54) METHOD FOR AN AUTONOMOUS LOADING SHOVEL

(75) Inventor: Ken Furem, Cumming, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 154 days.

This patent is subject to a terminal disclaimer.

(21) Appl. No.: 11/217,176

(22) Filed: Sep. 1, 2005

(65) Prior Publication Data

US 2006/0090378 A1 May 4, 2006

Related U.S. Application Data

(60) Provisional application No. 60/606,570, filed on Sep. 1, 2004.

(51) Int. Cl.
*G05D 1/02* (2006.01)

(52) U.S. Cl. ..... 37/348; 37/414; 701/50; 172/2; 172/3; 172/4.5

(58) Field of Classification Search ..... 37/348, 37/382, 413–416, 907
See application file for complete search history.

(56) References Cited

U.S. PATENT DOCUMENTS 3,863,741 A * 2/1975 Mitsuishi et al. ..... 191/12.2 A
3,943,306 A * 3/1976 Aihara et al. ..... 191/12.2 R
4,108,264 A * 8/1978 Tanaka ..... 180/2.1
4,511,100 A * 4/1985 Oetringhaus ..... 242/390.6
4,587,383 A * 5/1986 Stoldt ..... 191/12 R
5,495,157 A * 2/1996 Dade et al. ..... 318/432
5,546,093 A * 8/1996 Gudat et al. ..... 701/214
5,646,845 A * 7/1997 Gudat et al. ..... 701/41
5,682,312 A * 10/1997 Rocke ..... 701/50
5,924,493 A * 7/1999 Hartman et al. ..... 172/4.5
6,076,030 A * 6/2000 Rowe ..... 701/50
6,108,949 A * 8/2000 Singh et al. ..... 37/414
6,167,336 A * 12/2000 Singh et al. ..... 701/50
6,195,922 B1 * 3/2001 Stump ..... 37/348

(Continued)

OTHER PUBLICATIONS

"A Robotic Excavator for Autonomous Truck Loading", Anthony Stentz et al., The Robotics Institute; 0-7803-4465-0/98 IEEE, pp. 1885-1893.
PCT International Search Report PCT/US2005/031324 mailed Feb. 03, 2006.

*Primary Examiner*—Thomas A Beach
*Assistant Examiner*—Matthew R Buck
(74) *Attorney, Agent, or Firm*—Michael J. Wallace

(57) ABSTRACT

Certain exemplary embodiments can comprise a method for controlling a machine. The method can comprise a plurality of activities that can comprise determining a profile of a surface responsive to a scan of the surface. The method can comprise identifying a predetermined profile from a plurality of predetermined profiles, the identified predetermined profile a closest match of the plurality of predetermined profiles to the profile of the surface. The method can comprise determining a machine procedure based upon the identified predetermined profile. The method can comprise automatically executing the preferred machine procedure via a machine.

22 Claims, 18 Drawing Sheets

U.S. PATENT DOCUMENTS 6,351,697 B1 * 2/2002 Baker ..... 701/50
6,363,632 B1 * 4/2002 Stentz et al. ..... 37/414
6,363,832 B1 4/2002 Francis
6,549,752 B2 * 4/2003 Tsukamoto ..... 434/362
6,591,145 B1 * 7/2003 Hoskinson et al. ..... 700/28
6,711,838 B2 * 3/2004 Staub et al. ..... 37/348
6,917,839 B2 * 7/2005 Bickford ..... 700/30
2003/0019132 A1 * 1/2003 Kurenuma et al. ..... 37/348
2004/0020083 A1 * 2/2004 Staub et al. ..... 37/348

* cited by examiner

METHOD FOR AN AUTONOMOUS LOADING SHOVEL

CROSS-REFERENCES TO RELATED APPLICATIONS

This application claims priority to, and incorporates by reference herein in its entirety, U.S. Provisional Patent Application Ser. No. 60/606,570, filed 1 Sep. 2004.

BACKGROUND

Operation of large machines, such as mining shovels, can be costly. Costs of operation can comprise a salary of an operator. Additional costs can include maintaining environmental conditions suitable for the operator. For example, mining shovels can work in harsh environments. As a result, it is possible for the operator to be injured. Also, in some operations, altitude sickness can be a concern.

It is also possible that the operator might not operate an expensive machine according to operational rules and guidelines. As a result, maintenance costs of the machine can be relatively high. Other costs can comprise operator training and opportunity costs associated with down-time of machines when operators are not available due to vacation, sickness, etc. Hence, a system and method of operating a shovel, without the cost of human operation is disclosed.

SUMMARY

Certain exemplary embodiments can comprise a system and/or method for remote and/or autonomous operation of a machine. In an exemplary embodiment, the machine can be an excavator, such as an electric mining shovel. Autonomous control of the machine can reduce and/or eliminate operating personnel, which can significantly decrease costs associated with the machine.

BRIEF DESCRIPTION OF THE DRAWINGS

A wide variety of potential embodiments will be more readily understood through the following detailed description of certain exemplary embodiments, with reference to the accompanying exemplary drawings in which.

DEFINITIONS

Figure 1:
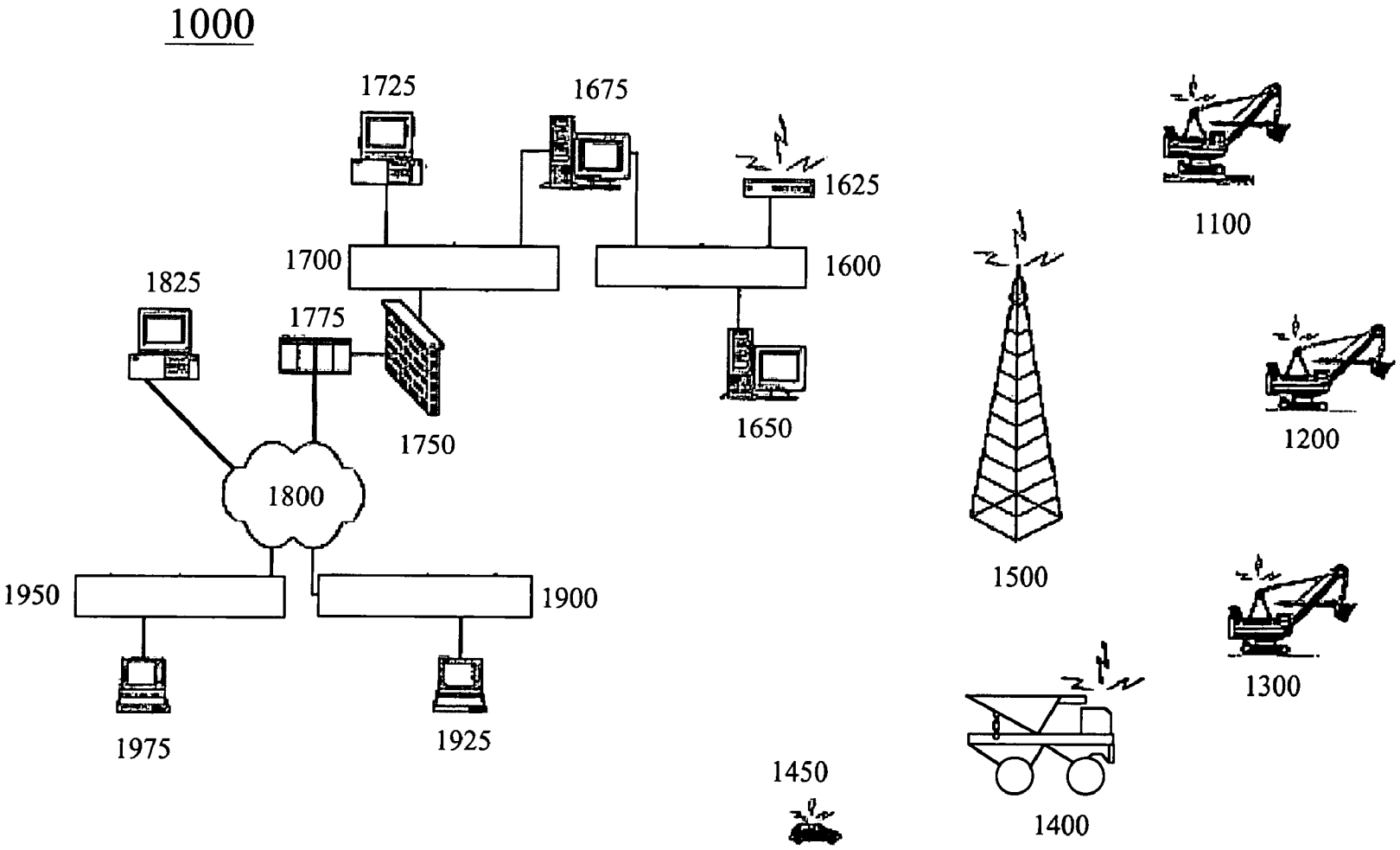
FIG. 1 is an exemplary block diagram of a system 1000 comprising autonomous machines.

When the following terms are used herein, the accompanying definitions apply:

a—at least one.

activity—an action, act, step, and/or process or portion thereof.

adapted to—made suitable or fit for a specific use or situation.

apparatus—an appliance or device for a particular purpose.

automatically—performed via an information device in a manner essentially independent of influence or control by a user.

bank—a sloped earthen surface.

boundary—a limit.

bypass—to avoid by using an alternative.

cable—an insulated conductor adapted to transmit electrical energy.

cable reel—a spool adapted to feed or retract an electrical cable.

calculating—determining via mathematics and/or logical rules.

can—is capable of, in at least some embodiments.

change—to cause a difference to occur.

closest—most nearly.

communicate—to exchange information.

communicative coupling—linking in a manner that facilitates communications.

comparing—examining in order to note similarities or differences between at least two items.

comprising—including but not limited to.

control—direct, exercise influence over.

cycle time—a time period associated with loading a haulage machine with an electric mining shovel.

data—distinct pieces of information, usually formatted in a special or predetermined way and/or organized to express concepts.

define—to establish the outline, form, or structure of.

detect—sense or perceive.

detector—a device adapted to sense or perceive.

determination—decision.

determining—deciding.

device—a machine, manufacture, and/or collection thereof.

digging library—a plurality of procedures and/or heuristic rules regarding digging procedures.

digging procedure—a sequence of steps and/or activities for removing material from an earthen surface.

digging surface—an earthen surface prepared for material removal.

dispatcher—a person, group of personnel, and/or software assigned to schedule personnel and/or machinery. For example, a dispatcher can schedule haulage machines to serve a particular electric mining shovel.

electric mining shovel—an electrically-powered device adapted to dig, hold, and/or move earthen materials.

electrical—pertaining to electricity.

event—an occurrence.

excavation machine—a machine adapted to move materials relative to an earthen surface. Excavating machines comprise excavators, backhoes, front-end loaders, mining shovels, and/or electric mining shovels, etc.

execute—run a computer program or instruction.

executing—running a computer program or instruction.

failed component—a machine part not properly functional.

fault—an imperfection, error, or discrepancy.

fault correction processor—a device adapted to automatically bypass a failed component of the electric mining shovel responsive to detecting the failed component.

finding—determining.

Global Position System (GPS)—a system adaptable to determine a terrestrial location of a device receiving signals from multiple satellites.

help entity—a person, machine, and/or software program adapted to provide assistance.

hoist—a system comprising motor adapted to at least vertically move a dipper of a mining shovel.

identification—evidence of identity; something that identifies a person or thing.

identify—determine.

information—data that has been organized to express concepts. Rules for composing information are "semantic" rules. It is generally possible to automate certain tasks involving the management, organization, transformation, and/or presentation of information.

information device—any device capable of processing information, such as any general purpose and/or special purpose computer, such as a personal computer, workstation, server, minicomputer, mainframe, supercomputer, computer terminal, laptop, wearable computer, and/or Personal Digital Assistant (PDA), mobile terminal, Bluetooth device, communicator, "smart" phone (such as a Treo-like device), messaging service (e.g., Blackberry) receiver, pager, facsimile, cellular telephone, a traditional telephone, telephonic device, a programmed microprocessor or microcontroller and/or peripheral integrated circuit elements, an ASIC or other integrated circuit, a hardware electronic logic circuit such as a discrete element circuit, and/or a programmable logic device such as a PLD, PLA, FPGA, or PAL, or the like, etc. In general any device on which resides a finite state machine capable of implementing at least a portion of a method, structure, and/or or graphical user interface described herein may be used as an information device. An information device can comprise well-known components such as one or more network interfaces, one or more processors, one or more memories containing instructions, and/or one or more input/output (I/O) devices, one or more user interfaces coupled to an I/O device, etc.

input/output (I/O) device—any sensory-oriented input and/or output device, such as an audio, visual, haptic, olfactory, and/or taste-oriented device, including, for example, a monitor, display, projector, overhead display, keyboard, keypad, mouse, trackball, joystick, gamepad, wheel, touchpad, touch panel, pointing device, microphone, speaker, video camera, camera, scanner, printer, haptic device, vibrator, tactile simulator, and/or tactile pad, potentially including a port to which an I/O device can be attached or connected.

instructions—directions adapted to perform a particular operation or function.

interference—something that obstructs or impedes.

invalid—unsound, faulty.

length—a longest dimension of an object.

load—an amount of mined earthen material associated with a dipper and/or truck, etc.

load cycle—a time interval beginning when a mine shovel digs earthen material and ending when a dipper of the mining shovel is emptied into a haulage machine.

location—a place substantially approximating where something physically exists.

machine positional limit—an extent of a machine's actual and/or preferred ability to reach, operate, and/or proceed.

machine readable medium—a physical structure from which a machine can obtain data and/or information. Examples include a memory, punch cards, etc.

maintenance activity—an activity relating to preserving performance of a device and/or system.

managing—exerting control over.

manually—substantially without assistance of an information device.

match—similar to.

may—is allowed to, in at least some embodiments.

measure—characterize by physically sensing.

measurement—a value of a variable, the value determined by manual and/or automatic observation.

memory device—an apparatus capable of storing analog or digital information, such as instructions and/or data. Examples include a non-volatile memory, volatile memory, Random Access Memory, RAM, Read Only Memory, ROM, flash memory, magnetic media, a hard disk, a floppy disk, a magnetic tape, an optical media, an optical disk, a compact disk, a CD, a digital versatile disk, a DVD, and/or a raid array, etc. The memory device can be coupled to a processor and/or can store instructions adapted to be executed by processor, such as according to an embodiment disclosed herein.

method—a process, procedure, and/or collection of related activities for accomplishing something.

mine—an excavation in the earth from which materials can be extracted.

mine haulage vehicle—a motorized machine adapted to haul material extracted from the earth.

network—a communicatively coupled plurality of nodes.

network interface—any device, system, or subsystem capable of coupling an information device to a network. For example, a network interface can be a telephone, cellular phone, cellular modem, telephone data modem, fax modem, wireless transceiver, ethernet card, cable modem, digital subscriber line interface, bridge, hub, router, or other similar device.

object—a physical thing.

operator—an entity able to control a machine.

optical—of or relating to light, sight, and/or a visual representation.

optimization routine—a set of machine-readable instructions adapted to automatically improve a digging procedure.

optimizing—improving.

parameter—a sensed, measured, and/or calculated value.

plurality—the state of being plural and/or more than one.

pocket of material—a volume of a substance with a defined extent.

power—a rate at which work is done, expressed as the amount of work per unit time and commonly measured in units such as the watt and horsepower.

power optimization routine—a set of machine-readable instructions adapted to determine a mining procedure utilizing a measured motor power as a performance measure.

predetermined—established in advance.

predetermined standard—a threshold established in advance.

preferred—improved as compared to an alternative.

procedure—a set of activities adapted to bring about a result.

processor—a device and/or set of machine-readable instructions for performing one or more predetermined tasks. A processor can comprise any one or a combination of hardware, firmware, and/or software. A processor can utilize mechanical, pneumatic, hydraulic, electrical, magnetic, optical, informational, chemical, and/or biological principles, signals, and/or inputs to perform the task(s). In certain embodiments, a processor can act upon information by manipulating, analyzing, modifying, converting, transmitting the information for use by an executable procedure and/or an information device, and/or routing the information to an output device. A processor can function as a central processing unit, local controller, remote controller, parallel controller, and/or distributed controller, etc. Unless stated otherwise, the processor can be a general-purpose device, such as a microcontroller and/or a microprocessor, such the Pentium IV series of microprocessor manufactured by the Intel Corporation of Santa Clara, Calif. In certain embodiments, the processor can be dedicated purpose device, such as an Application Specific Integrated Circuit (ASIC) or a Field Programmable Gate Array (FPGA) that has been designed to implement in its hardware and/or firmware at least a part of an embodiment disclosed herein.

profile—an outline of a surface.

prompt—to advise and/or remind.

provide—supply.

proximity sensor—a device adapted to detect a distance from an object.

related—associated with.

relative—compared to.

relocate—transfer from one location to another.

remote—in a distinctly different location.

rendered—made perceptible to a human. For example data, commands, text, graphics, audio, video, animation, and/or hyperlinks, etc. can be rendered. Rendering can be via any visual and/or audio means, such as via a display, a monitor, electric paper, an ocular implant, a speaker, and/or a cochlear implant, etc.

reset—a control adapted to clear and/or change a threshold.

responsive—reacting to an influence and/or impetus.

routine—a set of machine-readable instructions adapted to perform a specific task.

save—retain data in a memory device.

scan—information obtained via a systematic examination.

scan library—a repository having information regarding systematic examination of earthen surfaces and/or profiles.

scanner—a device adapted to systematic examination.

scanning—systematically examining.

schedule—plan for performing work.

select—choose.

sensor—a device adapted to measure a property. For example, a sensor can measure pressure, temperature, flow, mass, heat, light, sound, humidity, proximity, position, velocity, vibration, voltage, current, capacitance, resistance, inductance, and/or electro-magnetic radiation, etc.

server—an information device and/or software that provides some service for other connected information devices via a network.

set—a related plurality.

signaling—sending a message to.

sonar—of or relating to a use of transmitted and reflected sound waves such as to detect and/or locate objects and/or to measure a distance to a surface.

status—information relating to a descriptive characteristic of a device and or system. For example, a status can be on, off, and/or in fault, etc.

store—to place, hold, and/or retain data, typically in a memory.

stored—placed, held, and/or retained in a memory.

substantially—to a great extent or degree.

system—a collection of mechanisms, devices, data, and/or instructions, the collection designed to perform one or more specific functions.

torque—a moment of a force acting upon an object; a measure of the force's tendency to produce torsion and rotation in the object about an axis equal to the vector product of the radius vector from the axis of rotation to the point of application of the force and the force vector. Equivalent to the product of angular acceleration and mass moment of inertia of the object.

transceiver—a device adapted to transmit and/or receive signals.

transferring—transmitting from one device to another.

transmit—send a signal. A signal can be sent, for example, via a wire or a wireless medium.

user—a person interfacing with an information device.

user interface—any device for rendering information to a user and/or requesting information from the user. A user interface includes at least one of textual, graphical, audio, video, animation, and/or haptic elements. A textual element can be provided, for example, by a printer, monitor, display, projector, etc. A graphical element can be provided, for example, via a monitor, display, projector, and/or visual indication device, such as a light, flag, beacon, etc. An audio element can be provided, for example, via a speaker, microphone, and/or other sound generating and/or receiving device. A video element or animation element can be provided, for example, via a monitor, display, projectors and/or other visual device. A haptic element can be provided, for example, via a very low frequency speaker, vibrator, tactile stimulator, tactile pad, simulator, keyboard, keypad, mouse, trackball, joystick, gamepad, wheel, touchpad, touch panel, pointing device, and/or other haptic device, etc. A user interface can include one or more textual elements such as, for example, one or more letters, number, symbols, etc. A user interface can include one or more graphical elements such as, for example, an image, photograph, drawing, icon, window, title bar, panel, sheet, tab, drawer, matrix, table, form, calendar, outline view, frame, dialog box, static text, text box, list, pick list, pop-up list, pull-down list, menu, tool bar, dock, check box, radio button, hyperlink, browser, button, control, palette, preview panel, color wheel, dial, slider, scroll bar, cursor, status bar, stepper, and/or progress indicator, etc. A textual and/or graphical element can be used for selecting, programming, adjusting, changing, specifying, etc. an appearance, background color, background style, border style, border thickness, foreground color, font, font style, font size, alignment, line spacing, indent, maximum data length, validation, query, cursor type, pointer type, autosizing, position, and/or dimension, etc. A user interface can include one or more audio elements such as, for example, a volume control, pitch control, speed control, voice selector, and/or one or more elements for controlling audio play, speed, pause, fast forward, reverse, etc. A user interface can include one or more video elements such as, for example, elements controlling video play, speed, pause, fast forward, reverse, zoom-in, zoom-out, rotate, and/or tilt, etc. A user interface can include one or more animation elements such as, for example, elements controlling animation play, pause, fast forward, reverse, zoom-in, zoom-out, rotate, tilt, color, intensity, speed, frequency, appearance, etc. A user interface can include one or more haptic elements such as, for example, elements utilizing tactile stimulus, force, pressure, vibration, motion, displacement, temperature, etc.

validate—to establish the soundness of, e.g. to determine whether a communications link is operational.

value—an assigned or calculated numerical quantity.

velocity—speed.

wireless—any means to transmit a signal that does not require the use of a wire connecting a transmitter and a receiver, such as radio waves, electromagnetic signals at any frequency, lasers, microwaves, etc., but excluding purely visual signaling, such as semaphore, smoke signals, sign language, etc. Wireless communication can be via any of a plurality of protocols such as, for example, cellular CDMA, TDMA, GSM, GPRS, UMTS, W-CDMA, CDMA2000, TD-CDMA, 802.11a, 802.11b, 802.11g, 802.15.1, 802.15.4, 802.16, and/or Bluetooth, etc.

wireless transmitter—a device adapted to transfer a signal from a source to a destination without the use of wires.

DETAILED DESCRIPTION

Certain exemplary embodiments can provide a method for controlling a machine. The method can comprise a plurality of activities that can comprise determining a profile of a surface responsive to a scan of the surface. The method can comprise identifying a predetermined profile from a plurality of predetermined profiles, the identified predetermined profile a closest match of the plurality of predetermined profiles to the profile of the surface. The method can comprise determining a machine procedure based upon the identified predetermined profile. The method can comprise automatically executing the preferred machine procedure via a machine.

Certain exemplary embodiments can provide a system comprising a processor adapted to determine a profile of a surface responsive to a scan of the surface. The processor can be adapted to identify a predetermined profile from a plurality of predetermined profiles, the identified predetermined profile a closest match of the plurality of predetermined profiles to the profile of the surface. The processor can be adapted to determine a procedure based upon the identified predetermined profile. The processor can be adapted to provide the procedure to a machine.

FIG. 1 is a block diagram of an exemplary embodiment of a system 1000 comprising autonomous machines, such as autonomous machine 1100, autonomous machine 1200, and autonomous machine 1300. In embodiments related to excavation, autonomous machines 1100, 1200, 1300 can comprise excavators, backhoes, front-end loaders, mining shovels, and/or electric mining shovels, etc. Each of autonomous machines 1100, 1200, 1300 can comprise a wired communication interface, a wireless receiver and/or a wireless transceiver. The wireless receiver can be adapted to receive GPS information from a GPS satellite. The wired interface and/or the wireless transceiver can be adapted to send and/or receive information from a plurality of machines, sensors, and/or information devices directly and/or via a wireless communication tower 1500.

Autonomous machines 1100, 1200, 1300 can be adapted to load a haulage machine such as haulage machine 1400. Haulage machine 1500 can be a fossil fuel powered mining haul truck, electric mining haul truck, rail car, flexible conveyor train, in-pit crushing hopper, and/or truck with an open bed trailer, etc. Haulage machine 1400 can be adapted to directly and/or wirelessly communicate with autonomous machines 1100, 1200, 1300 directly and/or via communication tower 1500. Haulage machine 1400 can receive instructions for movement and activities from an information device such as information device 1650.

System 1000 can comprise a vehicle 1450, which can relate to operation and/or maintenance of autonomous machines 1100, 1200, 1300. For example, vehicle 1450 can be associated with a management entity responsible for monitoring performance of autonomous machines 1100, 1200, 1300. In certain exemplary embodiments, vehicle 1450 can be associated with a maintenance entity receiving information requesting maintenance activities for autonomous machines 1100, 1200, 1300. In certain exemplary embodiments, vehicle 1450 can be associated with a regulatory entity responsible for monitoring safety related to operation of autonomous machines 1100, 1200, 1300. Vehicle 1450 can be equipped with a wireless receiver and/or transceiver and be communicatively coupled to autonomous machines 1100, 1200, 1300.

System 1000 can comprise a plurality of networks, such as a network 1600, a network 1700, a network 1900, and a network 1950. Each of networks 1600, 1700, 1900, 1950 can communicatively couple information devices to autonomous machines 1100, 1200, 1300 directly and/or via wireless communication tower 1500. A wireless transceiver 1625 can communicatively couple wireless communication tower 1500 to information devices coupled via network 1600.

Network 1600 can comprise a plurality of communicatively coupled information devices such as a server 1650. Server 1650 can be adapted to receive, process, and/or store information relating to autonomous machines 1100, 1200, 1300. Network 1600 can be communicatively coupled to network 1700 via a server 1675. Server 1675 can be adapted to provide files and/or information sharing services between devices coupled via networks 1600, 1700. Network 1700 can comprise a plurality of communicatively coupled information devices, such as information device 1725.

Network 1700 can be communicatively coupled to network 1900 and network 1950 via a firewall 1750. Firewall 1750 can be adapted to restrict access to networks 1600, 1700. Firewall 1750 can comprise hardware, firmware, and/or software. Firewall 1750 can be adapted to provide access to networks 1600, 1700 via a virtual private network server 1725. Virtual private network server 1725 can be adapted to authenticate users and provide authenticated users, such as an information device 1825, an information device 1925, and an information device 1975, with a communicative coupling to autonomous machines 1100, 1200, 1300.

Virtual private network server 1725 can be communicatively coupled to the Internet 1800. The Internet 1800 can be communicatively coupled to information device 1825 and networks 1900, 1950. Network 1900 can be communicatively coupled to information device 1925. Network 1975 can be communicatively coupled to information device 1975.

Figure 2:
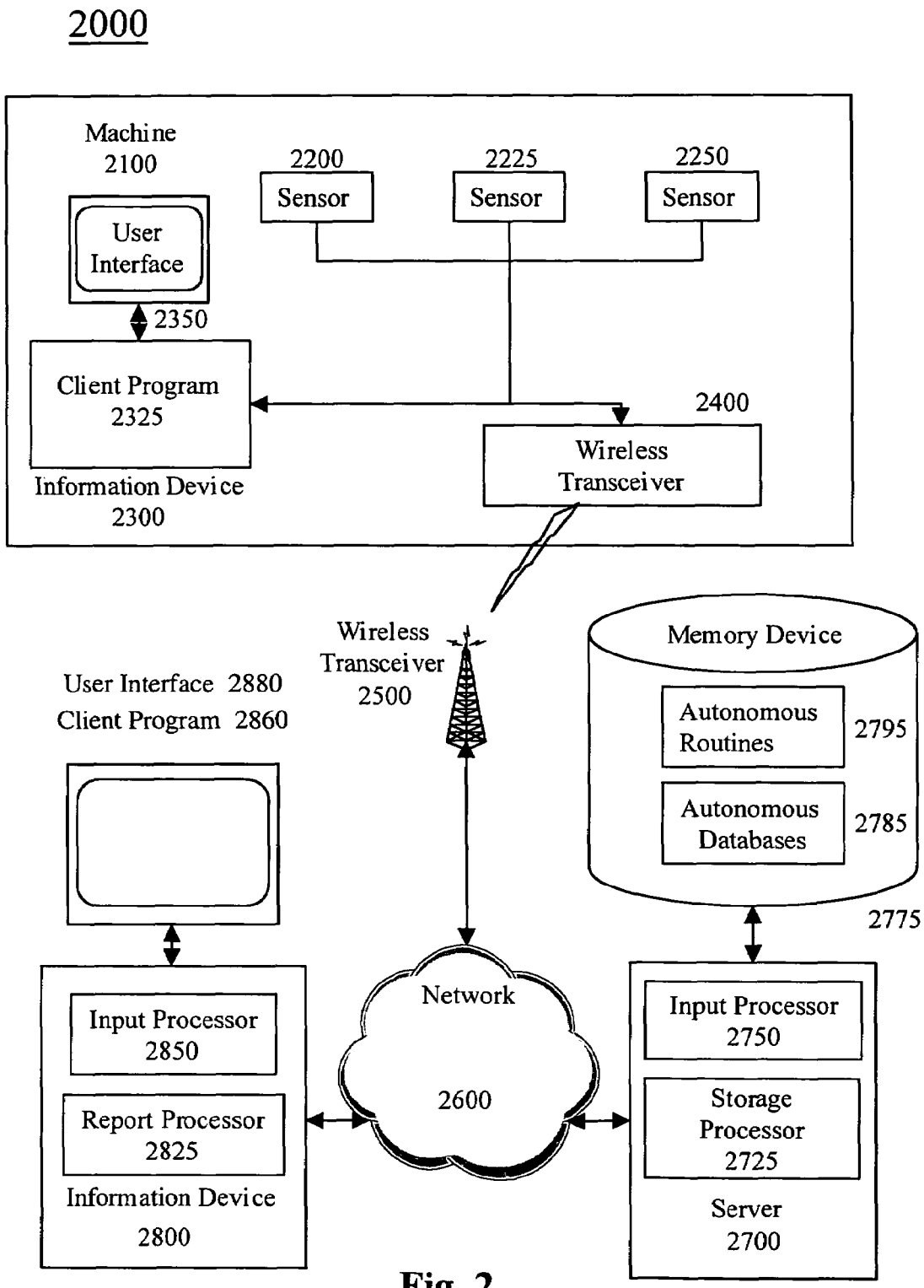
FIG. 2 is a block diagram of an exemplary embodiment of a system 2000 comprising an autonomous machine.

FIG. 2 is a block diagram of an exemplary embodiment of a system 2000 comprising an autonomous machine, which can comprise an autonomous machine 2100. Machine 2100 can be powered by one or more diesel engines, gasoline engines, and/or electric motors, etc. Machine 2100 can comprise a plurality of sensors, such as a sensor 2200, a sensor 2225, and a sensor 2250. Sensors 2200, 2225, 2250 can be adapted to measure pressure, temperature, flow, mass, heat, light, sound, humidity, proximity, position, velocity, vibration, voltage, current, capacitance, resistance, inductance, and/or electro-magnetic radiation, etc. Sensors 2200, 2225, 2250 can be communicatively coupled to an information device 2300 comprised in machine 2100, a wired network interface, and/or a wireless transceiver 2400.

Information device 2300 can comprise a user interface 2350 and a client program 2325. In certain exemplary embodiments, information device 2300 can be adapted to provide, receive, and/or execute a digging routine related to machine 2100. Information device 2300 can be communicatively coupled to a memory device adapted to store programs and/or information related to machine 2100.

Wireless transceiver 2400 can be communicatively coupled to a network 2600 via a wireless transceiver 2500. Network 2600 can comprise information devices adapted to communicate via various wireline or wireless media, such as cables, telephone lines, power lines, optical fibers, radio waves, light beams, etc. Network 2600 can be public, private, circuit-switched, packet-switched, connection-less, virtual, radio, telephone, POTS, non-POTS, PSTN, non-PSTN, cellular, cable, DSL, satellite, microwave, twisted pair, IEEE 802.03, Ethernet, token ring, local area, wide area, IP, Internet, intranet, wireless, Ultra Wide Band (UWB), Wi-Fi, BlueTooth, Airport, IEEE 802.11, IEEE 802.11a, IEEE 802.11b, IEEE 802.11g, X-10, and/or electrical power networks, etc., and/or any equivalents thereof.

Network 2600 can be communicatively coupled to a server 2700, which can comprise an input processor 2750 and a storage processor 2725. Input processor 2750 can be adapted to receive and process received information regarding machine 2100. For example, input processor 2750 can receive information from sensors 2200, 2225, 2250. Storage processor 2725 can be adapted to process information received by server 2700 and store the information in a memory device such as memory device 2775. Storage processor 2725 can be adapted to store information regarding machine 2100 in a format compatible with a data storage standard such as Knowledge Builder, SQL Server, MySQL, Microsoft Access, Oracle, FileMaker, Excel, SYLK, ASCII, Sybase, XML, and/or DB2, etc.

Memory device 2775 can store information such as autonomous machine databases 2785 and autonomous machine routines 2795. Autonomous machine databases 2785 can comprise a database of a plurality of digging surface profiles. Each of the plurality of digging surface profiles can be linked and/or associated with a digging procedure. Autonomous machine databases 2785 can comprise digging procedure information. Digging procedure information can comprise heuristic rules relating to extraction techniques for material excavation by machine 2100. Digging procedure information can comprise alternative procedures to be selected for adaptive learning algorithms associated with material extraction, such as mining, by machine 2100.

Autonomous machine routines 2785 can comprise one or more of the following routines:

- Bank Profiler—a routine that can be adapted to scan a digging surface. The scan can be compared to a scan library to correlate data. The scan can determine a bank profile;
- Digging Profile—a routine that can utilize the bank profile to search against a digging library to identify a predetermined bank profile of a plurality of predetermined bank profiles, the identified predetermined bank profile a closest match of the plurality of predetermined bank profiles to the profile of the digging surface. The plurality of bank profiles can be stored in the digging library;
- Digging Routine—a routine that can execute automatic optimization routines upon a digging procedure. The digging procedure can be determined based upon the identified bank profile from the digging library;
- Reclassification Routine—a routine adapted to compare the results of a modified digging procedure (including adjustments) against a prior digging procedure. If results from the modified digging procedure are better, then the library can be adjusted with the modified digging procedure;
- Load Truck Routine—a routine adapted to receive a Global Positioning System (GPS) signal from a haulage vehicle such as a truck, and calculate and execute a loading procedure. If the haulage vehicle is out of position—the haulage vehicle can be signaled to move into the correct position. After the truck is loaded, machine 2100 can return to a dig ready position;
- Confusion Routine—a routine that can be adapted to, if machine 2100 can't resolve any part of a problem, signal an operator to request manual guidance and/or control;
- Interference Routine—a routine adapted to, responsive to a sensed interference related to machine 2100, instruct machine 2100 to move to a determined position;
- Reposition Routine—a routine adapted to instruct machine 2100 to move and to control movement of machine 2100. Certain exemplary embodiments can comprise managing an electrical cable providing power to machine 2100;
- Fault Routine—a routine adapted to detect a problem with machine 2100. The routine can either instruct machine 2100 to correct the problem itself and/or or signal a help entity to correct the problem;
- Receive Dig Instructions—a routine adapted to receive instructions from a central control regarding where machine 2100 should dig and what boundaries of the pocket to be excavated;
- Limit Exception Profiler—a routine adapted to modify and/or compensate digging procedures based on positional limits of machine 2100; and
- Schedule Maintenance—a routine adapted to schedule maintenance based on measured events related to machine 2100.

Network 2600 can comprise an information device 2800. Information device 2800 can comprise a client program 2860 and a user interface 2880. Information device 2800 can comprise an input processor 2850 and a report processor 2825. Input processor 2850 can be adapted to receive information from sensors 2200, 2225, 2250 regarding machine 2100. Report processor 2825 can be adapted to prepare and provide reports utilizing information from sensors 2200, 2225, 2250 regarding machine 2100.

Figure 3:
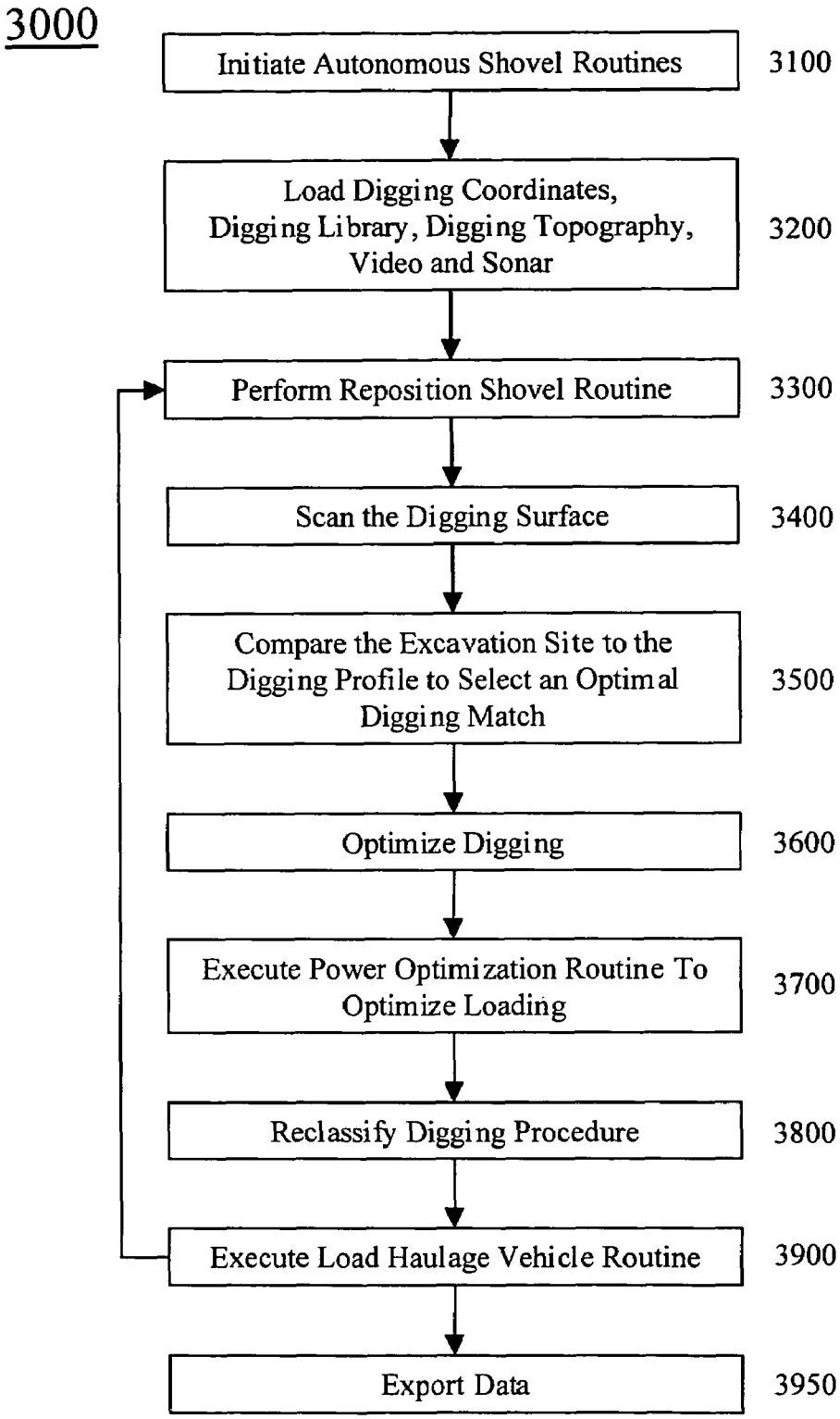
FIG. 3 is a flowchart of an exemplary embodiment of a method 3000.

FIG. 3 is a flowchart of an exemplary embodiment of a method 3000. At activity 3100 autonomous shovel routines can be initiated. Autonomous shovel routines can be adapted to autonomously control a mining shovel such as an electric mining shovel.

At activity 3200 the autonomous shovel routines can load digging coordinates, a digging library, a digging topography, video representations of a digging surface, and/or sonar representations of the digging surface, etc. Information regarding the physical environment and digging procedures can be adapted for use in autonomously controlling the shovel.

At activity 3300 the shovel can be repositioned according to a procedure determined by the autonomous shovel routines. The shovel can be repositioned in a manner that comprises automatically adjusting an extended length of an electrical cable providing power to the shovel.

At activity 3400 a digging surface can be scanned. The scan can comprise determining an angle of repose of material to be mined and/or extracted by the shovel, a particle size distribution of a pile of earthen material, a largest rock in the pile, objects and/or topography that can interfere with activities of the shovel, and/or vehicles in the area of the shovel and/or haulage machines associated with the shovel.

At activity 3500 the scan of the digging surface can be utilized to identify a predetermined bank profile from a plurality of predetermined bank profiles. The identified predetermined bank profile can be a closest match of the plurality of predetermined bank profiles to a profile of the digging surface determined via the scan. Based upon this identification, a first shovel digging procedure is selected from a plurality of shovel digging procedures.

At activity 3600, the first shovel digging procedure can be optimized. The preferred shovel digging procedure can be optimized by determining a second shovel digging procedure. Results from the first shovel digging procedure and the second shovel digging procedure can be predicted and compared. Based upon the comparison a preferred shovel digging procedure can be selected.

At activity 3700, a power optimization routine can be executed to optimize loading. The power optimization routine can measure a power associated with a movement of a dipper associated with the shovel. The power optimization routine can be adapted to fill the dipper with earthen material in an optimal manner. The optimal manner can consider an amount of earthen material filling the dipper, an amount of energy used in filling the dipper, and/or an amount of material desired to be placed in a haulage vehicle.

At activity 3800, a digging procedure can be reclassified. The results from executing the preferred digging procedure can be compared to past results from alternative digging procedures. If results from the preferred digging procedure are improved, a stored procedure can be modified, which can result in a control system for the shovel that can adaptively learn and can adaptively improve performance.

At activity 3900, a haulage vehicle can be loaded by the shovel according to the preferred shovel digging procedure.

At activity 3950, data associated with the shovel can be exported. The exported data can comprise information related to the preferred digging procedure, production information related to the shovel, detected problems with the shovel, scheduled maintenance associated with the shovel, and/or records relating to movement of the shovel, etc.

Figure 4:
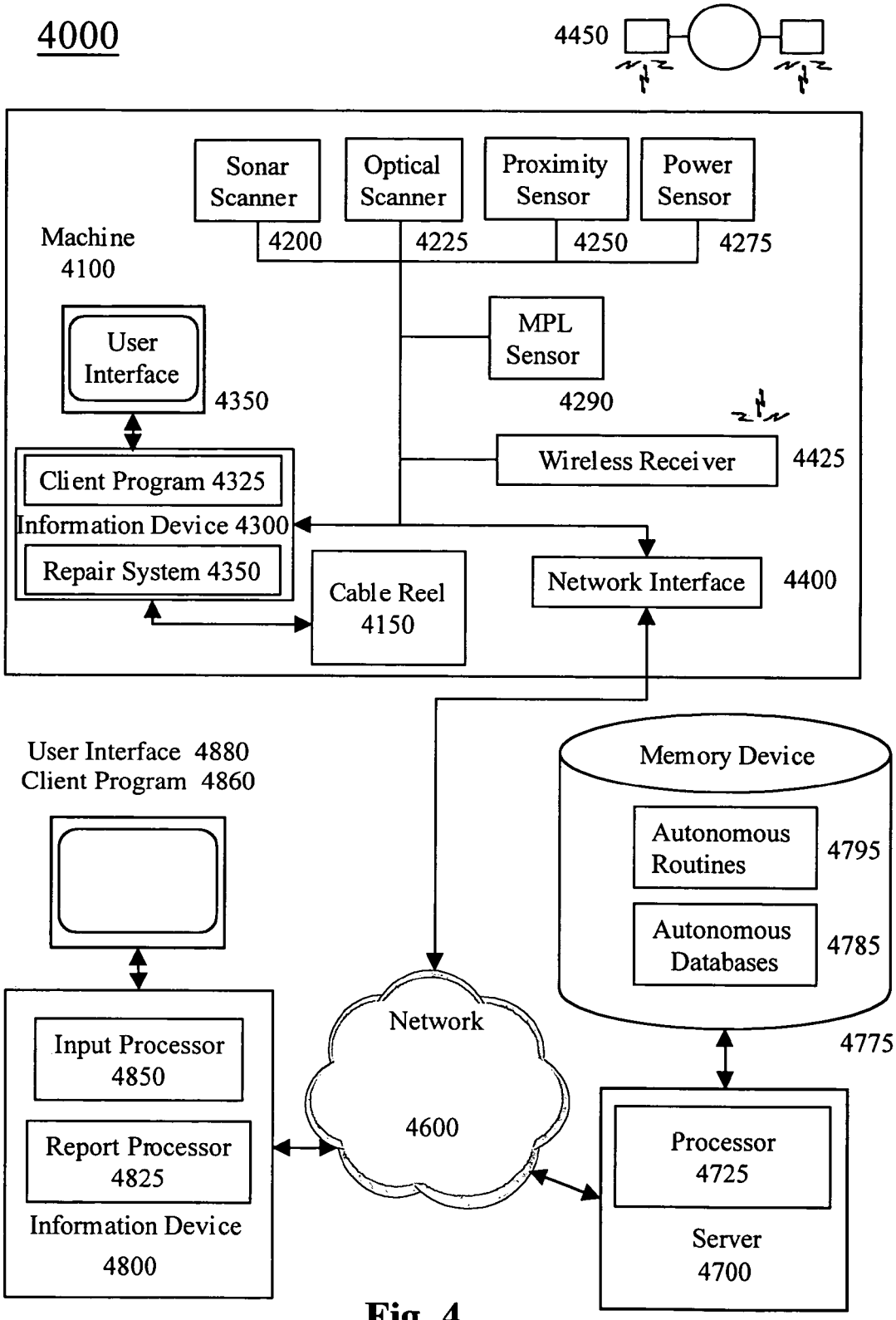
FIG. 4 is a block diagram of an exemplary embodiment of a system 4000 comprising an autonomous machine.

FIG. 4 is a block diagram of an exemplary embodiment of a system 4000 comprising an autonomous machine 4100. Autonomous machine 4100 can comprise a cable reel 4150. Cable reel 4150 can be adapted to change an extended length of an electrical cable utilized to provide power for operating and moving machine 4100. In certain exemplary embodiments, cable reel 4150 can be automatically controlled to change the extended length of the electrical cable when machine 4100 is automatically relocated.

Autonomous machine 4000 can comprise a plurality of sensors such as a sonar scanner 4200, optical scanner 4225, proximity sensor 4250, power sensor 4275, and machine positional limit sensor 4275. Sonar scanner 4200 and optical scanner 4225 can be adapted to provide a scan of a surrounding environment to machine 4400. For example, sonar scanner 4200 and optical scanner 4225 can be adapted to determine a profile of a digging surface upon which machine 4100 may dig. In certain exemplary embodiments, sonar scanner 4200 and optical scanner 4225 can be used to detect and/or provide a profile of objects in the vicinity of machine 4200. For example, sonar scanner 4200 and optical scanner 4225 can detect the present of a vehicle, such as a haulage vehicle or a service vehicle, in the vicinity of machine 4200.

Information provided by sonar scanner 4200 and optical scanner can be analyzed utilizing a pattern classification and/or recognition algorithm such as a decision tree, Bayesian network, neural network, Gaussian process, independent component analysis, self-organized map, and/or support vector machine, etc. The algorithm can facilitate performing tasks such as pattern recognition, data extraction, classification, and/or process modeling, etc. The algorithm can be adapted to improve performance and/or change its behavior responsive to past and/or present results encountered by the algorithm. The algorithm can be adaptively trained by presenting it examples of input and a corresponding desired output. For example, the input might be a plurality of sensor readings associated with an identification of a detected object or profile. The algorithm can be trained using synthetic data and/or providing data related to the component prior to previously occurring failures. The algorithm can be applied to almost any problem that can be regarded as pattern recognition in some form. In certain exemplary embodiments, the algorithm can be implemented in software, firmware, and/or hardware, etc.

Proximity sensor 4250 can be adapted to provide information regarding objects close to machine 4100 that might interfere with a movement of machine 4100. For example, proximity sensor 4250 can provide information regarding the presence of an object that interferes with a proposed relocation of machine 4100. For example, the presence of a large rock adjacent to a track of machine 4100 might prevent machine 4100 from traversing a path over the large rock.

Power sensor 4275 can be adapted to provide a measured motor power and/or torque associated with machine 4100. For example, power sensor 4275 can be adapted to provide a measured motor power for moving a dipper of an electric mining shovel in one or more directions. Information provided by power sensor 4275 can be used by an information device, such as information device 4300, to determine and/or optimize a digging procedure.

Machine positional limit sensor 4275 can be adapted for use in detecting an extent of motion of one or more parts of machine 4100. In certain exemplary embodiments, machine positional limit sensor 4275 can provide information indicative of a physical position of a dipper associated with machine 4100 in relation to a physical object. Information provided by machine positional limit sensor 4275 can be used to plan machine movements and relocations during an execution of the digging procedure. For example, machine positional limit sensor 4275 can provide information indicating that machine 4100 is too close to a portion of a bank to remove material therefrom. In certain exemplary embodiments, machine positional limit sensor 4275 can provide information indicating that machine 4100 is too far away to a portion of a bank to remove material therefrom.

Information device 4300 can comprise a user interface 4350, a client program 4325, and a repair system 4350. A user designing, operating, or troubleshooting autonomous machine 4100 can view information related to machine 4100 via user interface 4350. Client program 4350 can be adapted to provide information regarding and/or control machine 4100. For example, client program 4325 can be adapted to determine a digging procedure to be executed by machine 4100.

Repair system 4350 can be adapted to automatically repair a fault detected at machine 4100. For example, a variable frequency drive for an electric motor might fail. If machine 4100 comprises a switchable redundant and/or spare variable frequency drive, repair system 4350 can be adapted to automatically switch to the spare drive. As another example, a programmable logic controller processor might fail. If machine 4100 comprises a switchable spare programmable logic controller, repair system 4350 can be adapted to automatically switch to the spare programmable logic controller.

Machine 4100 can comprise a wireless receiver 4425. Wireless receiver 4425 can be adapted to receive Global Position System (GPS) information from a GPS satellite 4450. GPS information received via wireless receiver 4425 can comprise a location of machine 4100, a mining vehicle, and/or a haulage vehicle. Information received via wireless receiver 4425 can be adapted for use in planning and/or executing digging procedures by machine 4100.

Machine 4100 can comprise a network interface 4400, which can be a wired and/or wireless network interface, which can be adapted for use in transferring information regarding machine 4100 to and/or from information devices communicatively coupled to a network 4600. Network interface 4400 can be communicatively coupled to network 4600. Network interface 4400 can be adapted to receive instructions regarding the digging surface. Network interface 4400 can be adapted to receive instructions regarding a pocket of material to be removed by machine 4100. Information device 4300 and/or server 4700 can be adapted to use the instructions regarding the digging surface and/or the instructions regarding the pocket of material to determine a digging procedure for machine 4100.

Server 4700 can be communicatively coupled to machine 4100 via network 4600. In certain exemplary embodiments, the functionality described for server 4700 can be implemented via information device 4300 comprised in machine 4100. Server 4700 can comprise a processor 4725, which can be adapted to determine a profile of a digging surface responsive to a scan of the digging surface. For example, via a pattern recognition algorithm, processor 4725 can characterize information detected during a scan of the environment of machine 411 by sonar scanner 4200 and optical scanner 4225. Information relating to the profile can be compared to other stored profiles. For example, processor 4725 can execute instructions adapted to identify a predetermined bank profile from a plurality of predetermined bank profiles, which can be stored in a memory device such as memory device 4775. The identified predetermined bank profile can be a closest match of the plurality of predetermined bank profiles to the profile of the digging surface.

Processor 4725 can be adapted to execute instructions to determine a digging procedure for machine 4100 based upon the identified predetermined bank profile. Processor 4725 can be adapted to use received GPS information regarding machine 4100, a haulage vehicle, and/or a mining vehicle in determining the first digging procedure.

Responsive to the identified predetermined bank profile, processor 4725 can be adapted to execute an optimization routine to determine a second digging procedure. Processor 4725 can be adapted to execute instructions to compare the first digging procedure to the second digging procedure (and/or additional digging procedures) to determine an optimal, improved, and/or preferred digging procedure. Processor 4725 can be adapted to provide the digging procedure to machine 4100.

Memory device 4775 can be adapted to store autonomous machine databases 4785 and autonomous machine routines 4795. For example, autonomous machine databases 4785 can comprise the plurality of predetermined bank profiles. In certain exemplary embodiments, autonomous machine databases 4785 can comprise a plurality of digging procedures usable by machine 4100. The plurality of digging procedures can be modified according to adaptive learning as mining procedures are performed and results measured.

Autonomous machine routines 4795 can comprise routines to select, optimize, and/or modify procedures associated with operating machine 4100. Autonomous machine routines 4795 can comprise any of autonomous machine routines 2785 discussed in relation to FIG. 2.

Network 4600 can be communicatively coupled to an information device 4800, which can comprise a report processor 4825, an input processor 4850, a client program 4860, and a user interface 4880. Information device 4800 can be utilized by a user to monitor and/or control machine 4100 from a remote location. In certain exemplary embodiments, information device 4800 can obtain information from machine 4100 and/or server 4700 in order to monitor and/or control machine 4100.

Figure 5:
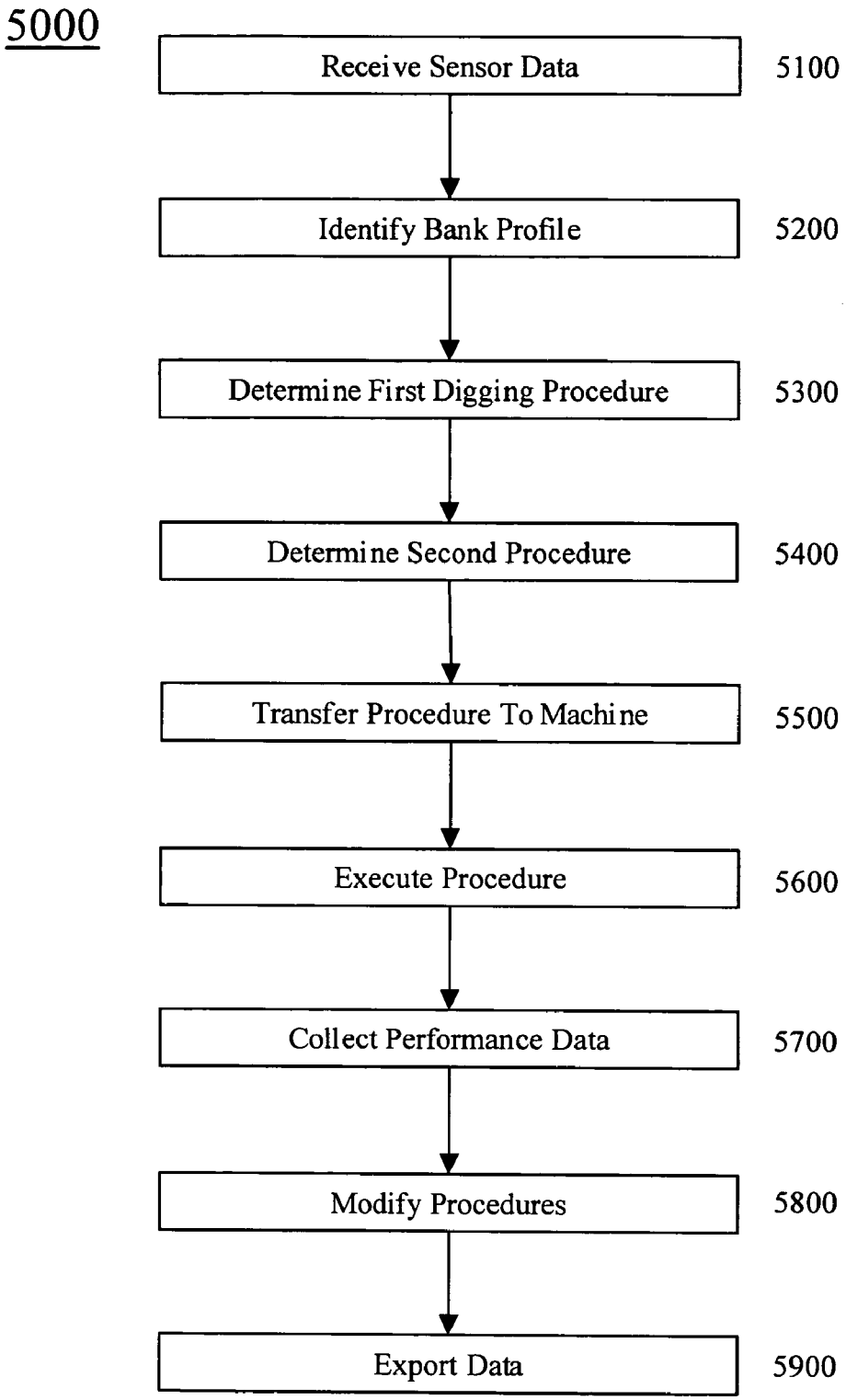
FIG. 5 is a flowchart of an exemplary embodiment of a method 5000.

FIG. 5 is a flowchart of an exemplary embodiment of a method 5000. At activity 5100, sensor data can be received. Sensors can be locally mounted on a machine or remotely mounted. Remotely mounted sensors can be communicatively coupled to the machine via wired and/or wireless transceivers. Sensor data can comprise information from a video and/or a sonar system scan regarding a profile of a digging surface. Sensor data can comprise information relating to a machine positional limit related to the machine. For example, a sensor might detect an extent to which a machine dipper can reach in order to determine whether the machine can excavate a particular boulder from a current location. If the machine positional limit indicates an excavation is not possible, instructions can be provided to automatically relocate the machine.

Sensor data can comprise a location of the mining haulage vehicle relative to the electric mining shovel. Sensor data can comprise a GPS signal related to the machine or from a mining haulage vehicle, the GPS signal can be indicative of the location of the machine, a mining vehicle, and/or the mining haulage vehicle. Sensor data can comprise information related to an interference such as an interference detected by a proximity detector.

At activity 5200, a bank profile can be identified. In certain exemplary embodiments, a predetermined bank profile can be identified from a plurality of predetermined bank profiles. The identified predetermined bank profile can be a closest match of the plurality of predetermined bank profiles to the profile of the digging surface.

At activity 5300, a first digging procedure can be determined. The first digging procedure can be based upon the identified predetermined bank profile. The first digging procedure can be determined responsive to instructions regarding material removal. For example, instructions can be received regarding a digging surface and/or characteristics, such as a boundary, of a pocket of material to be removed by the machine. For example, a management entity might establish a boundary for a pocket of material to be excavated based upon an ore grade being too low.

Different situations can make alternate procedures more desirable. For example, the first digging procedure might be different for removing a pocket of earthen material adjacent to a cliff as compared to an area not adjacent to a cliff. As another example, a digging procedure for earthen material with a largest particle size of six inches might be different than a digging procedure for earthen material with a largest particle size of sixty inches. The first digging procedure can comprise a procedure for loading a haulage vehicle by the machine.

At activity 5400, a second digging procedure can be determined. The second digging procedure can be determined by executing an optimization routine, a portion of which can heuristically or randomly vary a value of one or more parameters associated with the first digging procedure. The optimization routine can use any of a plurality of response surface or expert system derived algorithms to seek an optimal procedure for digging material. Then, the optimization procedure can utilize and/or invoke a modeling procedure to predict results and/or performance of the first digging procedure and/or the second digging procedure. The optimization routine can determine and/or select a preferred procedure by comparing the modeled results and/or performance of the first digging procedure to those of the second digging procedure.

In certain exemplary embodiments, the optimization routine can automatically detect an interference with an object. The optimization routine can comprise a power optimization routine, which can determine a procedure for efficiently loading a haulage vehicle.

At activity 5500, the preferred procedure can be transferred to the machine for execution. In certain exemplary embodiments, the preferred procedure can be determined locally at the machine such that the transfer takes place within the machine. In certain exemplary embodiments, the procedure can be transmitted from an information device to the machine.

At activity 5600, the preferred procedure can be executed at the machine. The executed procedure can comprise loading a haulage vehicle based upon the preferred procedure. If a location of a haulage vehicle is determined to be undesired, certain exemplary embodiments can transmit instructions adapted to automatically relocate the haulage vehicle to a desired location.

In certain exemplary embodiments, if a determination is made that a value of a parameter related to control of the machine is invalid, instructions can be provided to an operator to manually control the machine. Manual control of the machine can continue until a cause of the invalid value of the parameter is isolated and/or corrected.

Executing the procedure can comprise automatically relocating the machine responsive to procedural instructions to do so. In certain exemplary embodiments, executing the procedure can comprise automatically relocating the machine responsive to detection of an interference of the machine with an object. Automatic relocation of the machine can comprise managing an electrical cable coupled to the machine.

Executing the procedure can comprise detecting a fault with the machine. In certain exemplary embodiments, the detected fault can be automatically repaired. For example, a faulty component can be bypassed utilizing an available spare component. In certain exemplary embodiments, a signal can be transmitted to a help entity responsive to the detected fault in the machine. In certain exemplary embodiments, a maintenance activity can be scheduled for the machine responsive to a detected event. The detected event can be the fault, a measured degradation in machine performance, a measured period of time since a last scheduled maintenance, a detected temperature, a detected vibration, and/or a detected pressure, etc.

At activity 5700, performance data can be collected relating to execution of the preferred procedure. Sensors can record activities of the procedure and results from the execution of the procedure. The results can be compared to predictions and/or results from previous procedures.

At activity 5800, procedures can be modified. Procedure results can provide an indication of improvement or a lack of improvement as a result of a procedural change. If improvements are noted, procedural rules can be modified to incorporate a beneficial change. If no improvement is noted or performance degrades, procedures and/or rules used to generate procedures can be modified to avoid repeating procedural steps leading to the unimproved results.

At activity 5900 data can be exported. Data can be communicated via wired and/or wireless transmissions from the machine to at least one information device. Exported data can be analyzed by users and/or information devices to further understand and improve operating procedures and/or performance of the machine.

Figure 6:
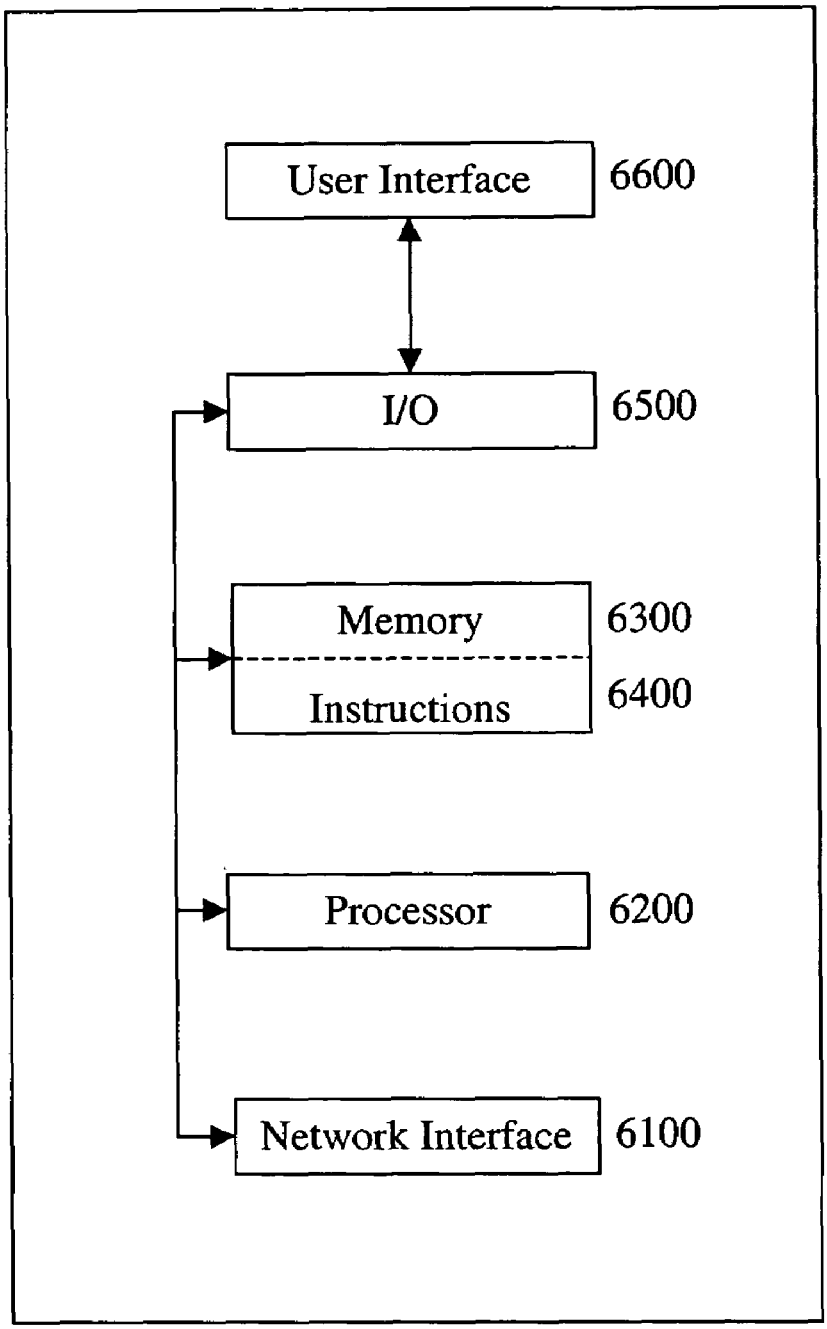
FIG. 6 is a block diagram of an exemplary embodiment of an information device 6000.

FIG. 6 is a block diagram of an exemplary embodiment of an information device 6000, which in certain operative embodiments can comprise, for example, server 4700, information device 4300, and information device 4800 of FIG. 4. Information device 6000 can comprise any of numerous well-known components, such as for example, one or more network interfaces 6100, one or more processors 6200, one or more memories 6300 containing instructions 6400, one or more input/output (I/O) devices 6500, and/or one or more user interfaces 6600 coupled to I/O device 6500, etc.

In certain exemplary embodiments, via one or more user interfaces 6600, such as a graphical user interface, a user can view a rendering of information related to a machine which is adapted to dig. For example, user interface 6600 can be adapted to display information comparing productivity of an autonomous machine to manually operated machines and/or industry standards, display an algorithm for autonomous operation of the machine, display information relating to invalid parameter values resulting in manual or partially manual control of the machine, and/or video displays related to the operation and/or environment of the machine, etc.

Figure 7:
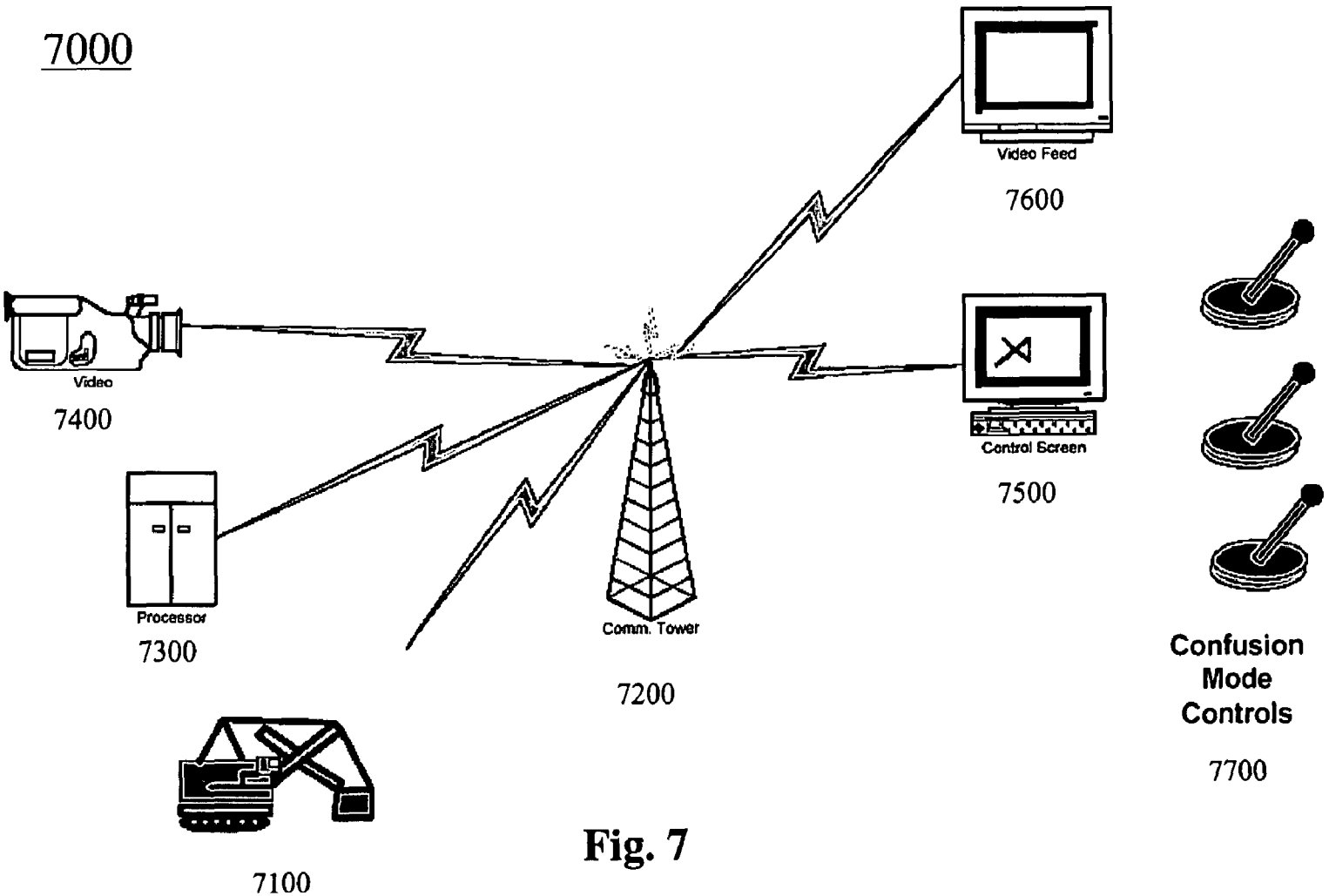
FIG. 7 is a block diagram of an exemplary embodiment of a system 7000 comprising an autonomous machine.

FIG. 7 is a block diagram of an exemplary embodiment of a system 7000 comprising an autonomous machine 7100. Autonomous machine 7100 can be communicatively coupled via wired link to a network and/or a wireless link to a communication tower 7200. Communication tower 7200 can communicatively couple autonomous machine 7100 to a processor 7300. In certain exemplary embodiments, autonomous machine 7100 can be directly couple to processor 7300.

System 7000 can comprise a video sensor 7400, which can communicate with processor 7300 directly and/or via communication tower 7200. Video sensor 7400 can provide digging profile information regarding an earthen surface adapted for digging by machine 7100. Video sensor 7400 can be adapted to provide images related to machine 7100 from a variety of perspectives and for a variety of purposes. For example, video sensor 7400 can provide a perspective view of a mine for a human or machine based entity to review overall mine operations and/or performance. Video sensor 7400 can be mounted on a haulage vehicle associated with machine 7100 in order to view a loading of material on the haulage vehicle. Video sensor 7400 can be locally mounted on machine 7100 in order to provide a view of a particular part of machine 7100 or a digging surface associated with machine 7100. Information collected by video sensor 7400 can be displayed via a video feed interface 7600. Information collected by video sensor 7400 can be automatically analyzed by a pattern recognition algorithm for analytic purposes.

Information related to autonomous or semi-autonomous control of machine 7100 can be viewed via a control screen 7500. Responsive to an invalid value detected by machine 7100 an operator can assume full or partial control of machine 7100 via confusion mode controls 7700. The operator can control machine 7100 either locally or remotely.

Figure 8:
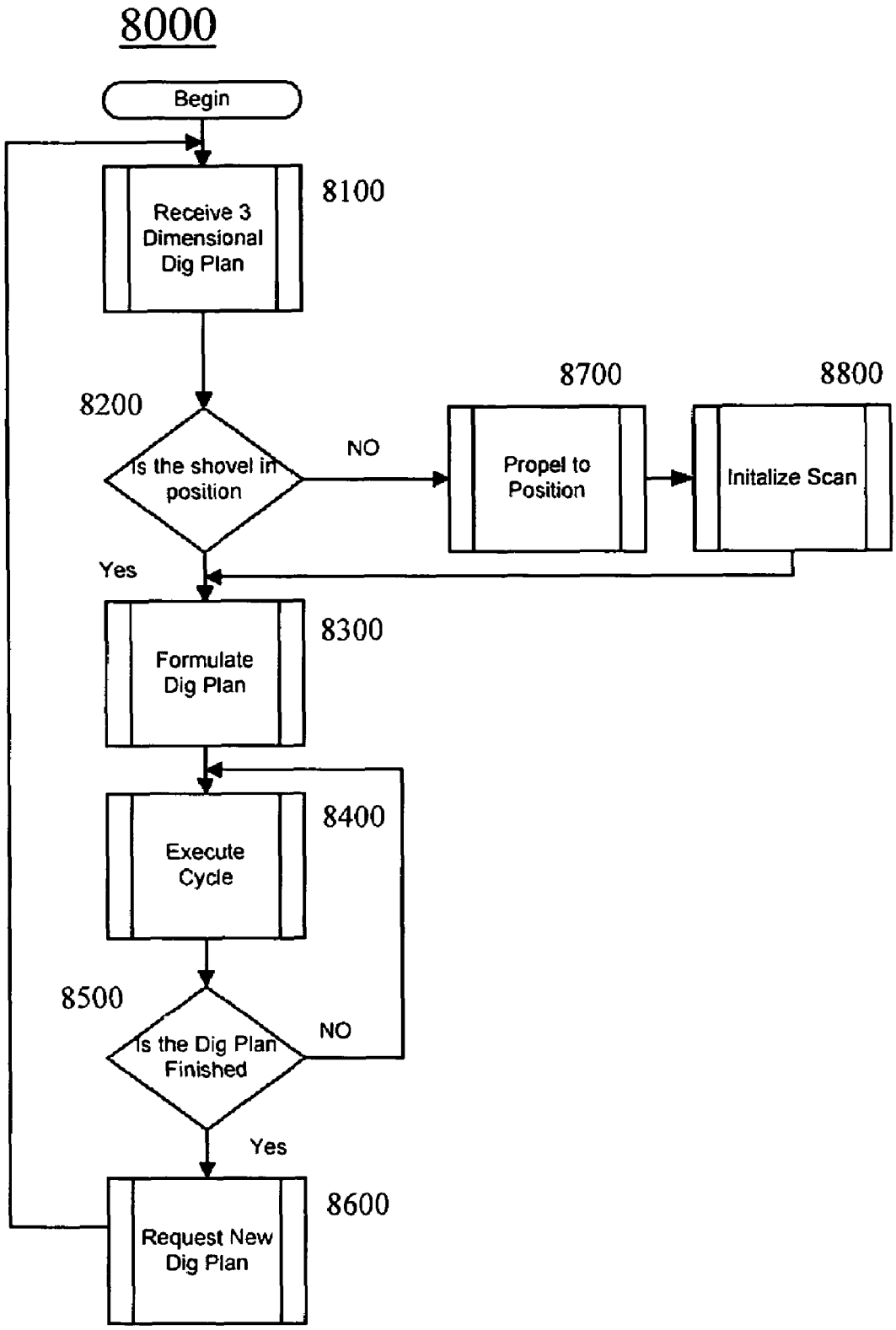
FIG. 8 is a flowchart of an exemplary embodiment of a method 8000.

FIG. 8 is a flowchart of an exemplary embodiment of a method 8000 for a basic machine cycle. At activity 8100 a three dimensional dig plan can be received, which can comprise instructions relating to a digging activity of a machine. The three dimensional dig plan can be received from an external entity such as an engineering entity. At activity 8200, a determination can be made regarding whether the machine, such as a shovel is in a proper position.

If the shovel is in the proper position, activity 8300 can be executed. At activity 8300, a digging plan can be formulated by an information device. At activity, 8400 the digging plan can be executed. At activity 8500, a determination can be made whether the digging plan is finished. If the digging plan has not been completed, activity 8400 can be repeated. If the digging plan is finished, activity 8600 can take place. At activity 8600, a new digging plan can be requested by the machine.

If the shovel is not in the proper position at activity 8200, activity 8700 can take place. At activity 8700, the machine can be propelled to a proper position. At activity 8800 a scan of a digging surface can be made.

Figure 9:
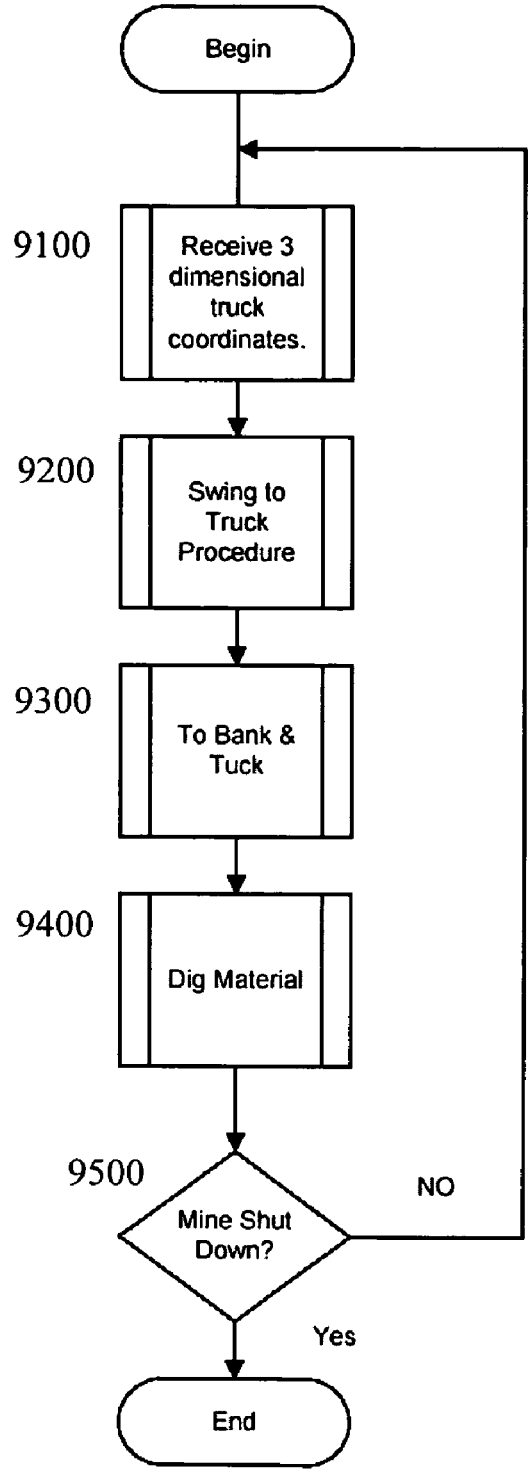
FIG. 9 is a flowchart of an exemplary embodiment of a method 9000.

FIG. 9 is a flowchart of an exemplary embodiment of a method 9000 for loading a haulage vehicle with a machine. At activity 9100, three dimensional coordinates of the haulage vehicle can be received. At activity 9200, a procedure can be defined to swing a load of earthen material to the haulage vehicle. At activity 9300, the machine can turn to a bank and tuck. In tucking, a dipper of the machine can be placed in a position to dig a next dipper of earthen material. At activity 9400, the machine can dig material to at least partially fill the dipper of the machine. At activity 9500, a determination can be made regarding whether the machine should be shut down. If not, activities resume at activity 9100.

Figure 10:
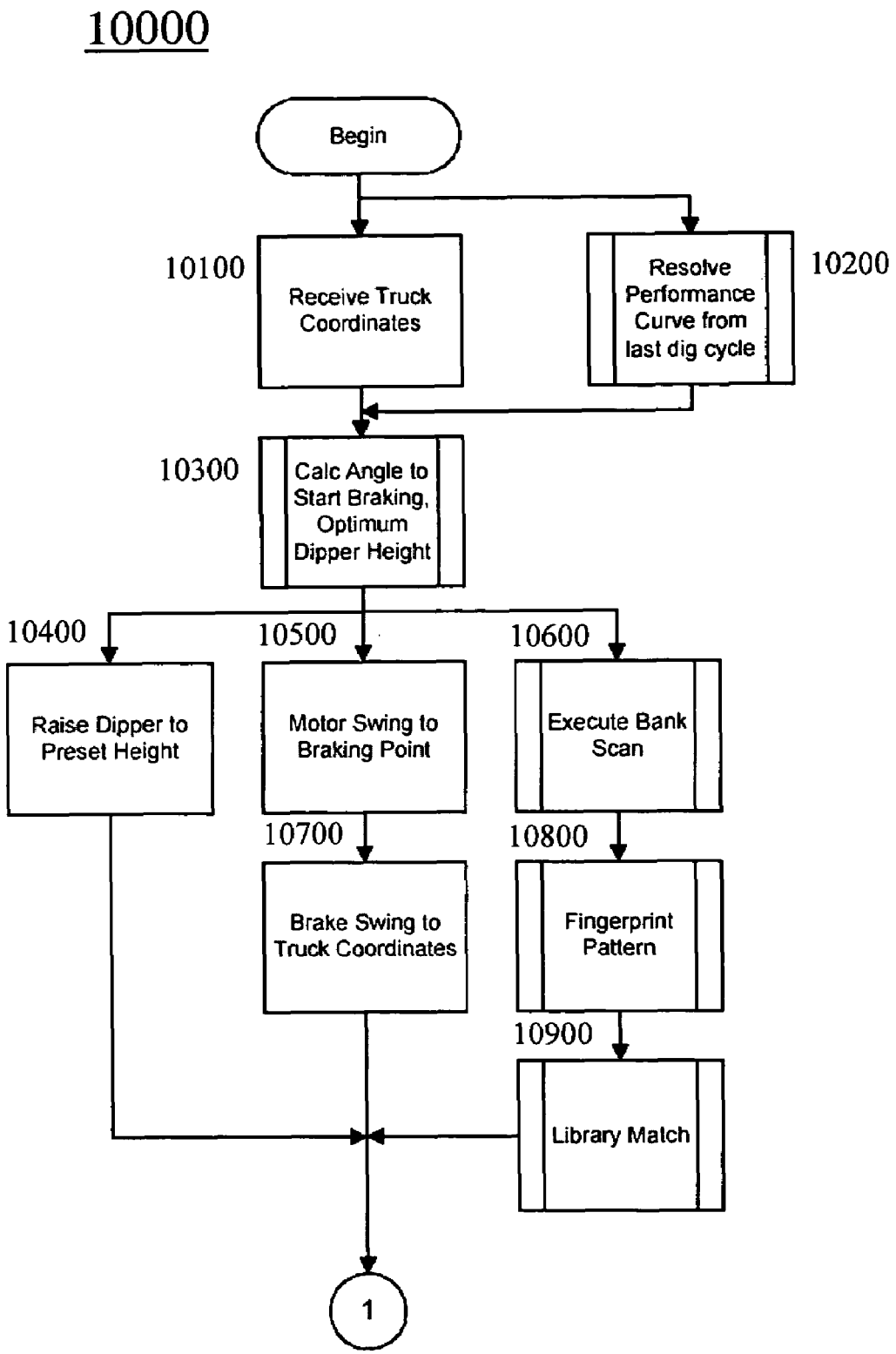
FIG. 10 is a flowchart of an exemplary embodiment of a method 10000.

FIG. 10 is a flowchart of an exemplary embodiment of a method 10000 for swinging a dipper of earthen material from a machine to a haulage vehicle. At activity 10100, coordinates of a haulage vehicle, such as a truck, can be received by and/or communicated to the machine. At activity 10200, a performance curve from a last dig can be resolved. The performance curve can comprise information relating to a power used and an amount of material dug during the last dig. The performance curve can be used to modify a digging procedure of the machine to improve energy efficiency.

At activity 10300, an angle can be calculated. The angle can provide information relating to when the machine should apply a brake to slow and/or stop a swinging motion to place a dipper associated with the machine in a position above a haulage cavity of the haulage vehicle. An optimum dipper height can be calculated for proper positioning of the dipper.

At activity 10400, the dipper can be raised to a preset height. At activity 10500, a motor controller can be instructed to swing the dipper to a braking point. At activity 10700, the brake can be applied to cause the dipper to swing to coordinates indicative of the haulage cavity of the haulage vehicle. At activity 10600, a bank scan can be executed. At activity 10800, a "fingerprint pattern" can be determined regarding the bank scan. The "fingerprint pattern" can be a characterization of the bank scan. At activity 10900, library match can be made wherein an identified profile can be found that is a closest match of the profile determined from the bank scan to a plurality of predetermined profiles.

Figure 11:
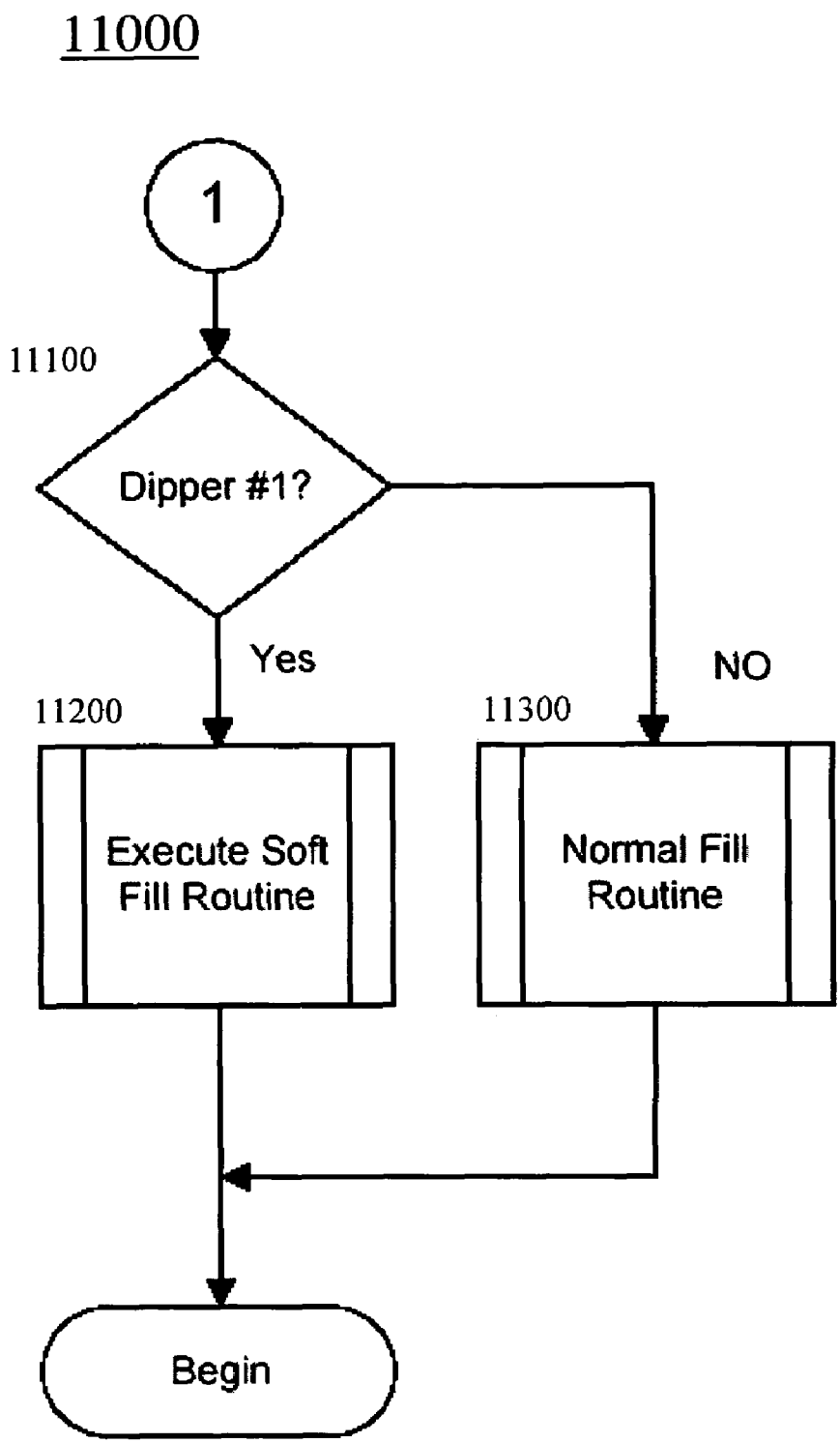
FIG. 11 is a flowchart of an exemplary embodiment of a method 11000 related to the method 10000.

FIG. 11 is a flowchart of an exemplary embodiment of a method 11000 related to the method 10000. Method 11000 is a continuation of method 10000. At activity 11100, a determination can be made whether a dipper of earthen material is a first dipper placed in the haulage vehicle. If the bucket is the first bucket placed in the haulage vehicle, the machine can execute a soft fill routine. The soft fill routine can involve a shorter distance between the dipper and the cavity of the haulage vehicle. In certain exemplary embodiments, the dipper can be emptied more slowly than if additional earthen material were present in the haulage cavity of the haulage vehicle. If the dipper of earthen material is not the first placed in the haulage vehicle, at activity 11300, a normal fill routine can be executed. The normal fill routine can be appropriate when a bed of material in the cavity of the haulage vehicle acts to at least partial shield surfaces of the haulage vehicle to prevent damage to the haulage vehicle.

Figure 12:
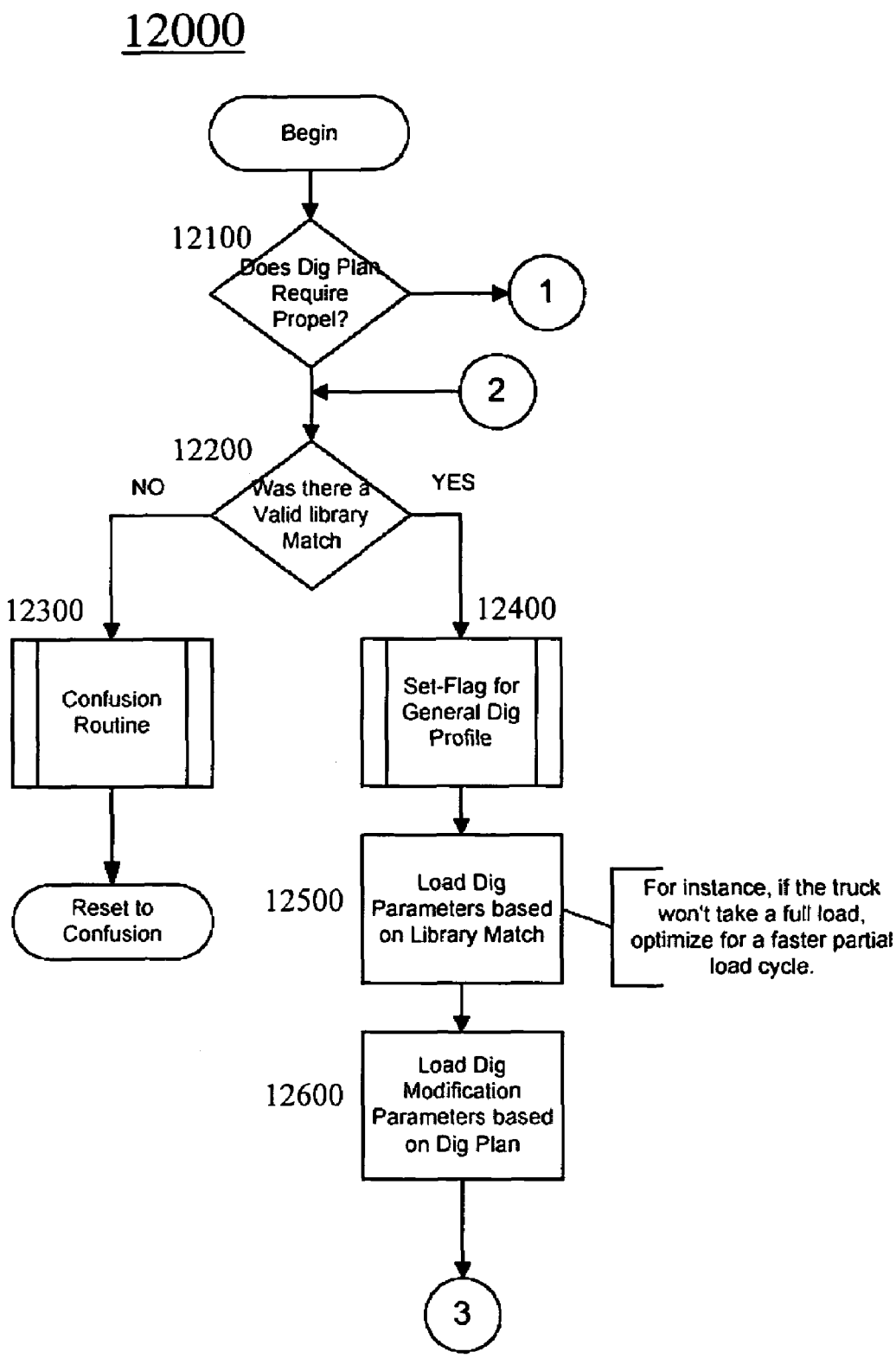
FIG. 12 is a flowchart of an exemplary embodiment of a method 12000.

FIG. 12 is a flowchart of an exemplary embodiment of a method 12000 for preparing for a digging activity. At activity 12100 a determination can be made regarding whether a digging plan requires a machine to be propelled, or relocated. If a propel is required, control passes to method 14000 of FIG. 14. If no propel is required, at activity 12200 a determination is made whether a profile of a digging surface substantially matches an identified predetermined bank profile of a plurality of predetermined bank profiles. If no match is found, at activity 12300, a confusion routine is executed. The confusion routine is adapted to provide at least partial operator control for the machine.

If a match is found at activity 12200, at activity 12400, a flag can be set for a general dig profile. At activity 12500, dig parameters can be loaded based on the identified predetermined bank profile. Dig parameters can form a digging procedure. For example, if the haulage vehicle is not able to hold a full dipper load of material, a digging procedure can utilize a faster partial load cycle to fill the haulage vehicle. At activity 12600, dig modification parameters can be loaded based upon the dig plan. Control then can pass to method 13000 of FIG. 13.

Figure 13:
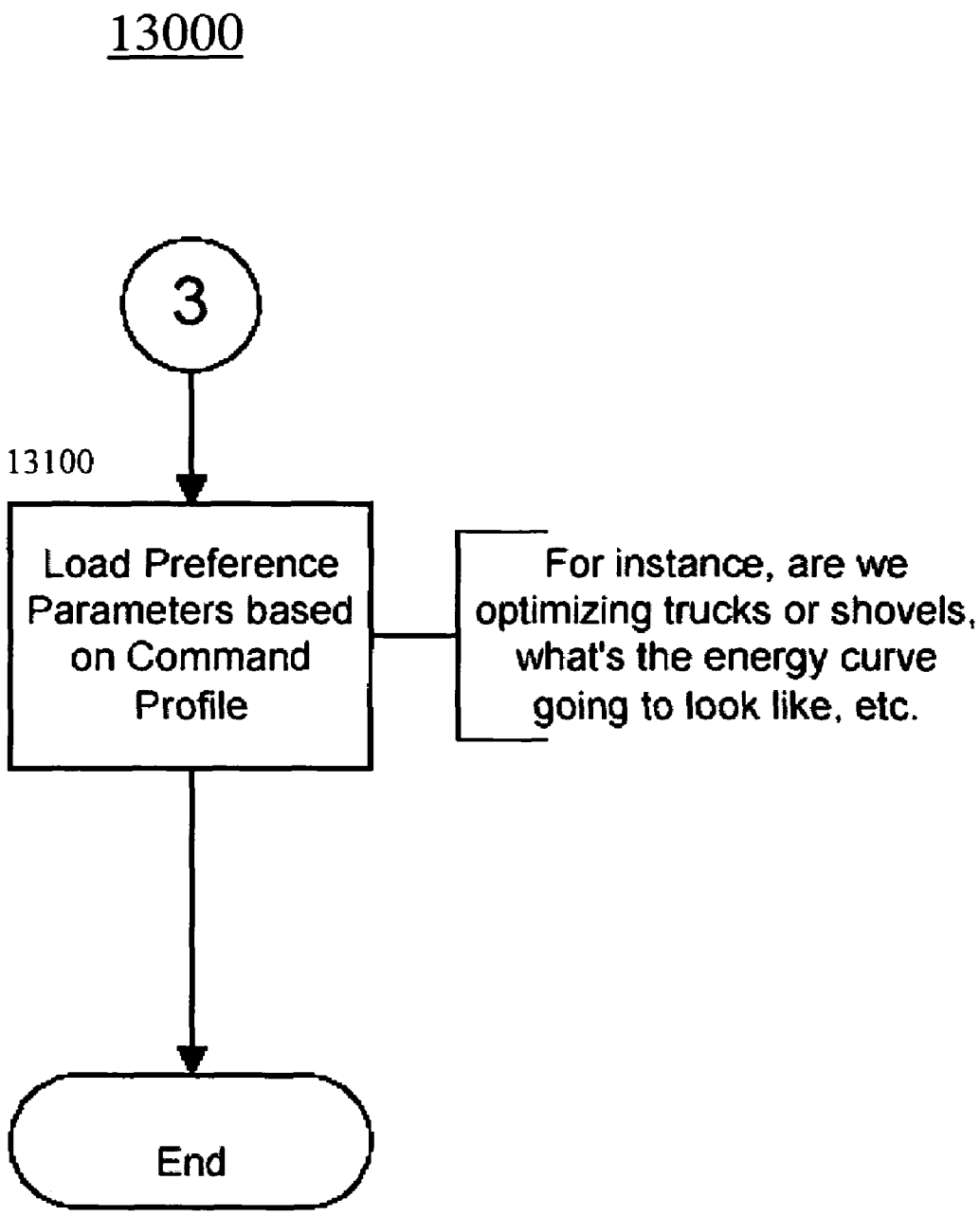
FIG. 13 is a flowchart of an exemplary embodiment of a method 13000 related to the method 12000.

FIG. 13 is a flowchart of an exemplary embodiment of a method 13000 related to the method 12000. At activity 13100, preference parameters can be loaded based on a command profile. For example, a procedure can consider an energy curve in developing a digging procedure in order to attempt to minimize unit energy consumption levels in excavation operations.

Figure 14:
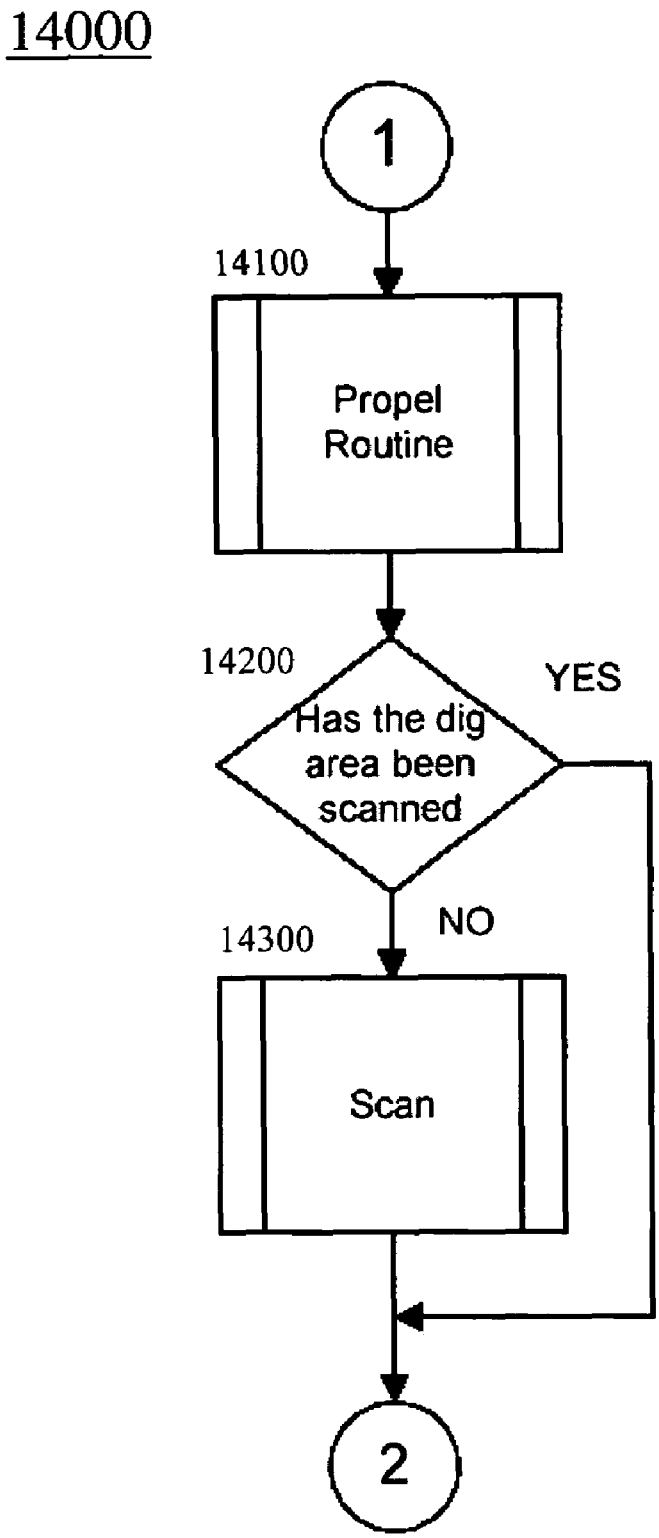
FIG. 14 is a flowchart of an exemplary embodiment of a method 14000 related to the method 12000.

FIG. 14 is a flowchart of an exemplary embodiment of a method 14000 related to the method 12000. At activity 14100, a propel routine can be executed to relocate the machine. At activity 14200, a determination can be made whether the dig area has been scanned. It the dig area has been scanned, control can be returned to activity 12200 of FIG. 12. If the dig area has not been scanned, at activity 14300, a scan can be made of the dig area. Control can then be returned to activity 12200 of FIG. 12.

Figure 15:
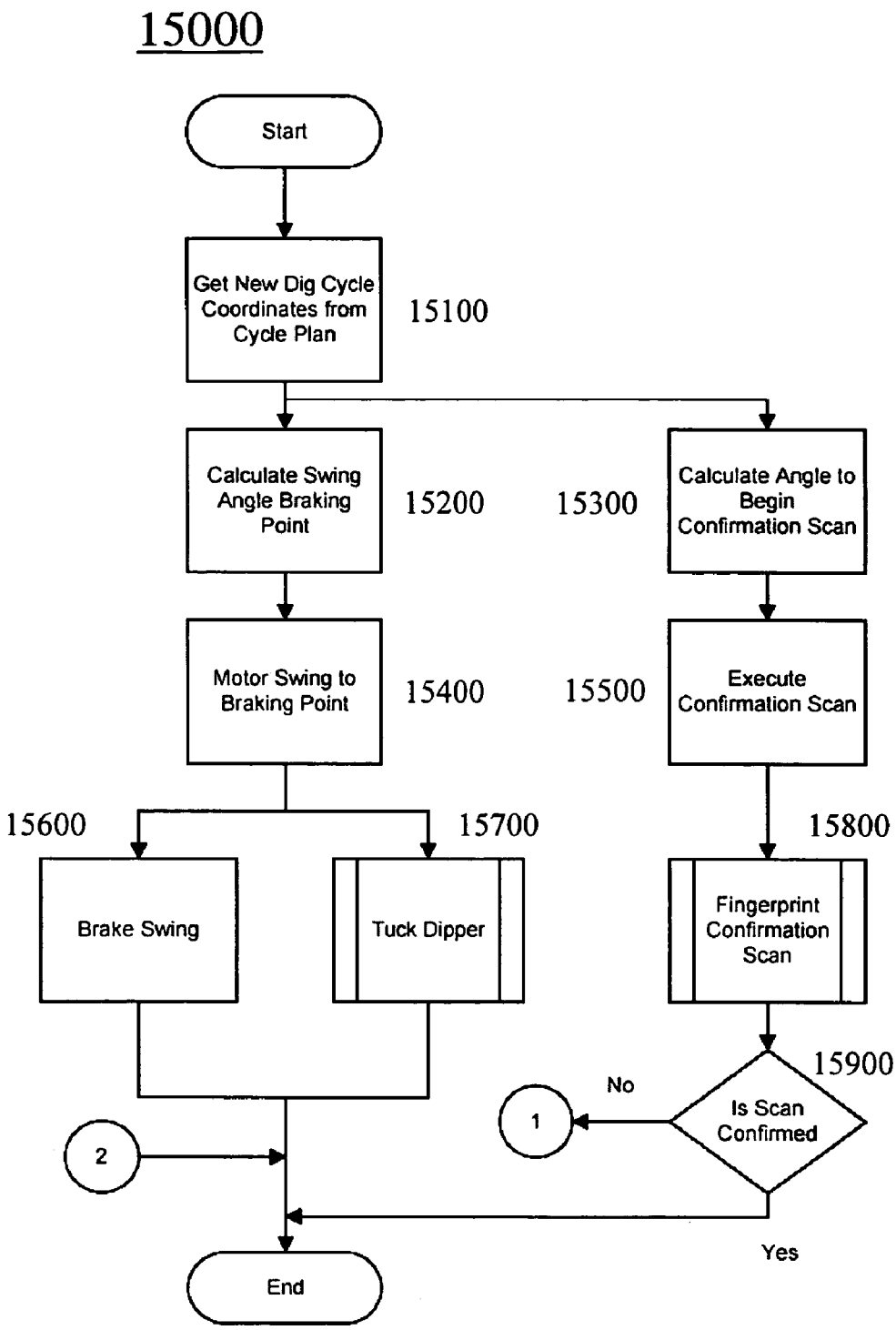
FIG. 15 is a flowchart of an exemplary embodiment of a method 15000.

FIG. 15 is a flowchart of an exemplary embodiment of a method 15000 for tucking a machine. At activity 15100, new dig cycle coordinates can be obtained from a cycle plan. At activity 15200, a swing angle braking point can be calculated.

At activity 15400, a motor propelling a dipper associated with the machine can swing to the swing angle braking point. At activity 15600, the dipper can be stopped via a brake. At activity 15700, the dipper can be tucked in preparation to dig a next dipper of earthen material.

At activity 15300, an angle to begin a confirmation scan can be calculated. At activity 15500, a confirmation scan can be executed. The confirmation scan can comprise a profile of a digging surface. At activity 15800, a "fingerprint confirmation" scan can be made. The "fingerprint confirmation" scan can be made to confirm a validity of a digging profile and/or a digging procedure. At activity 15900, a determination can be made regarding whether a scan has been confirmed. If the scan has been confirmed, method 15000 can end. If the scan is not confirmed, control can be passed to method 16000 of FIG. 16.

Figure 16:
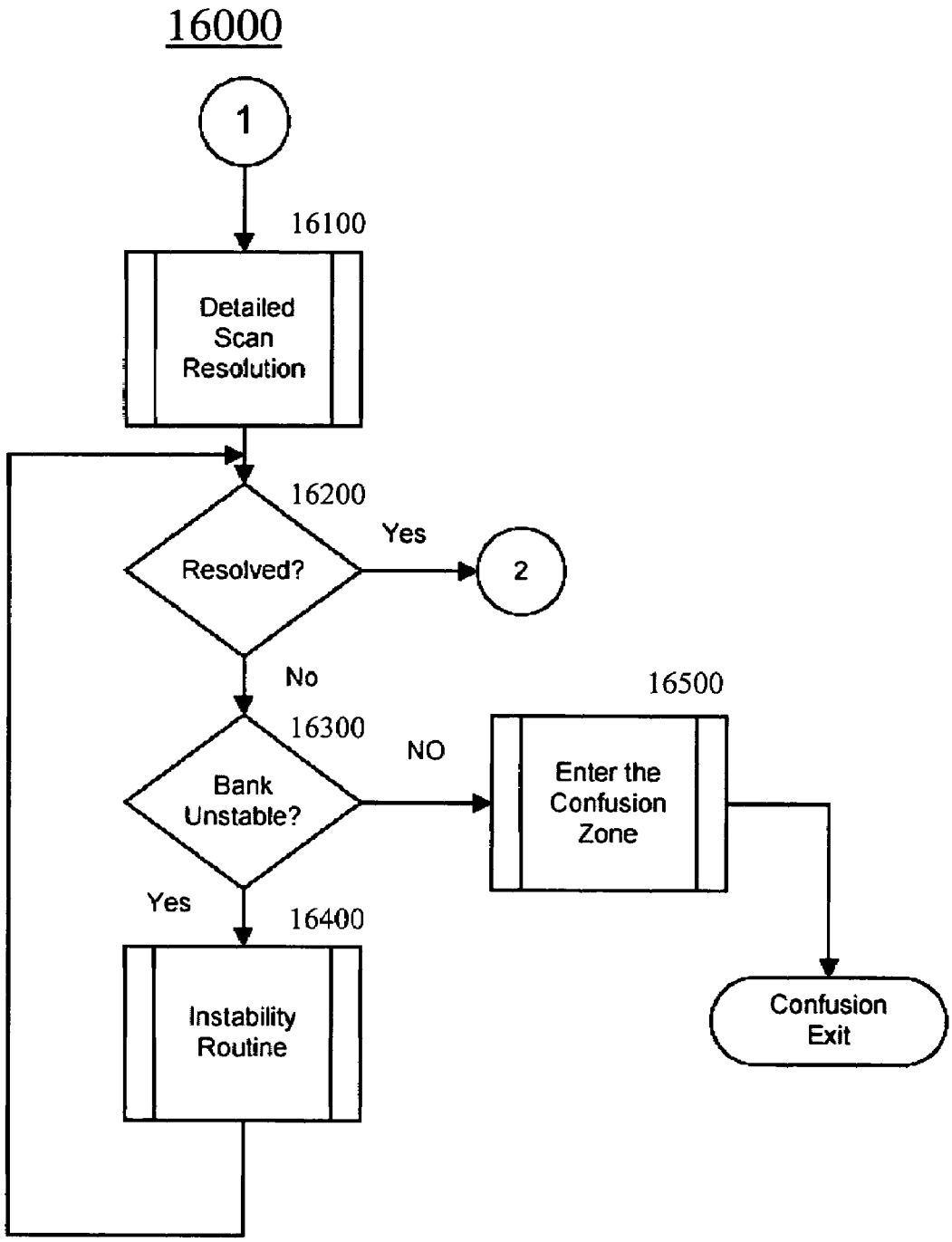
FIG. 16 is a flowchart of an exemplary embodiment of a method 16000 related to the method 15000.

FIG. 16 is a flowchart of an exemplary embodiment of a method 16000 related to the method 15000. At activity 16100, a detailed scan resolution can be performed. At activity 16200, a determination can be made regarding whether the detailed scan has been resolved. If the detailed scan has been resolved, procedure 15000 ends. If the detailed scan has not been resolved then, at activity 16300, a determination can be made whether the bank is unstable. If the bank is unstable, at activity 16400, an instability routine can be run. Control can then return to activity 16200. If the bank is determined not to be unstable, at activity 16500, a confusion routine can be executed. The confusion routine can be adapted to request at least partial control of the machine to an operator.

Figure 17:
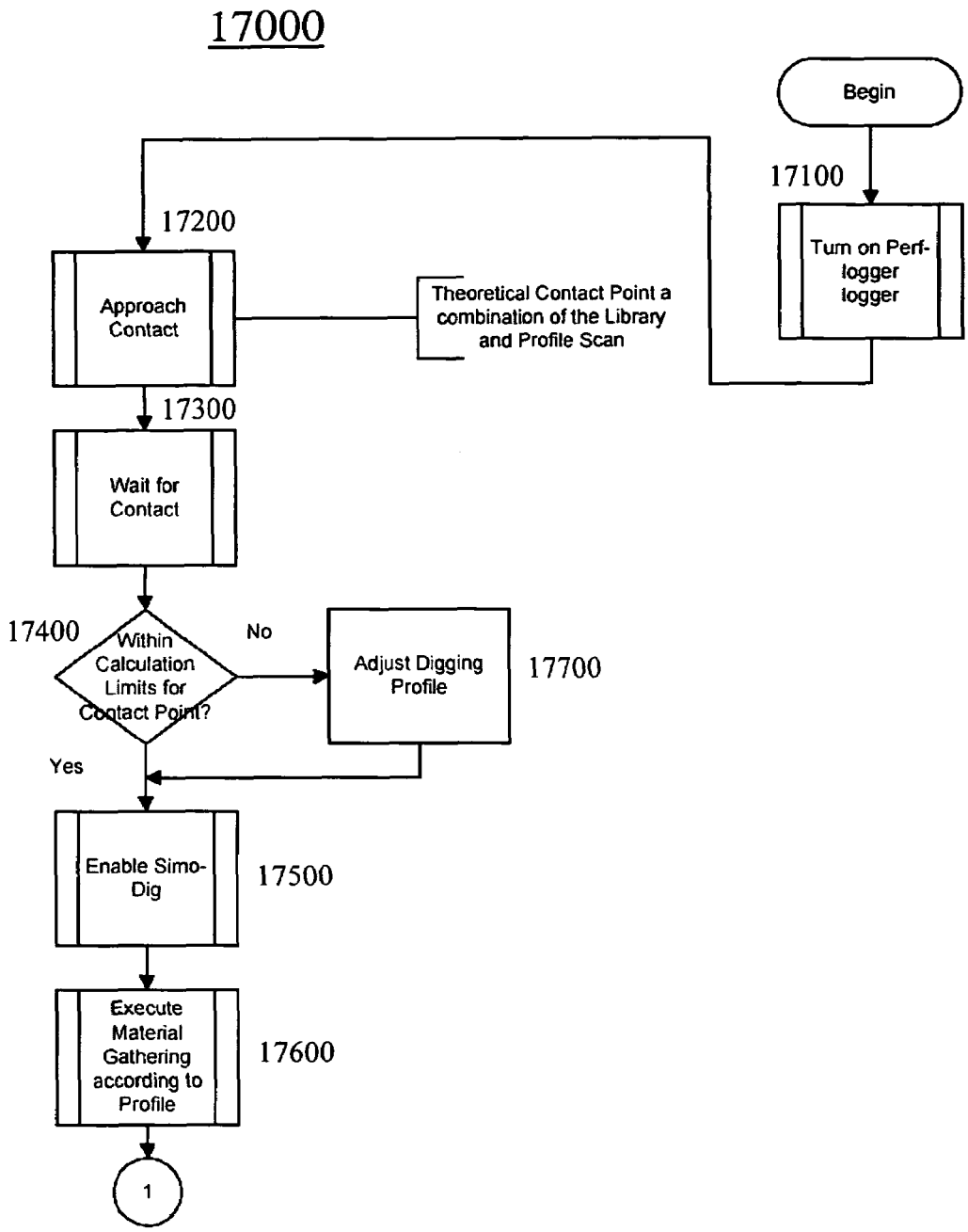
FIG. 17 is a flowchart of an exemplary embodiment of a method 17000.

FIG. 17 is a flowchart of an exemplary embodiment of a method 17000 for digging a bank with a machine. At activity 17100, a performance logger can be turned on. The performance logger can record activities associated with digging the bank for purposes of adaptive learning and improving mining procedures. At activity 17200, a contact point of a bank subject to digging can be approached. At activity 17300, the machine can wait to detect contact with the bank. At activity 17400, a determination can be made regarding whether contact with the bank has occurred within calculation limits. If contact has not been made within calculation limits, at activity 17700, a digging profile and/or procedure can be adjusted. Control can then return to activity 17500. If contact with the bank has occurred within calculation limits, at activity 17500, a Simodig procedure can be enabled. The Simodig procedure can be adapted to autonomously dig the bank. At activity 17600, material gathering can be executed according to the profile and/or digging procedure. Control can then pass to method 18000.

Figure 18:
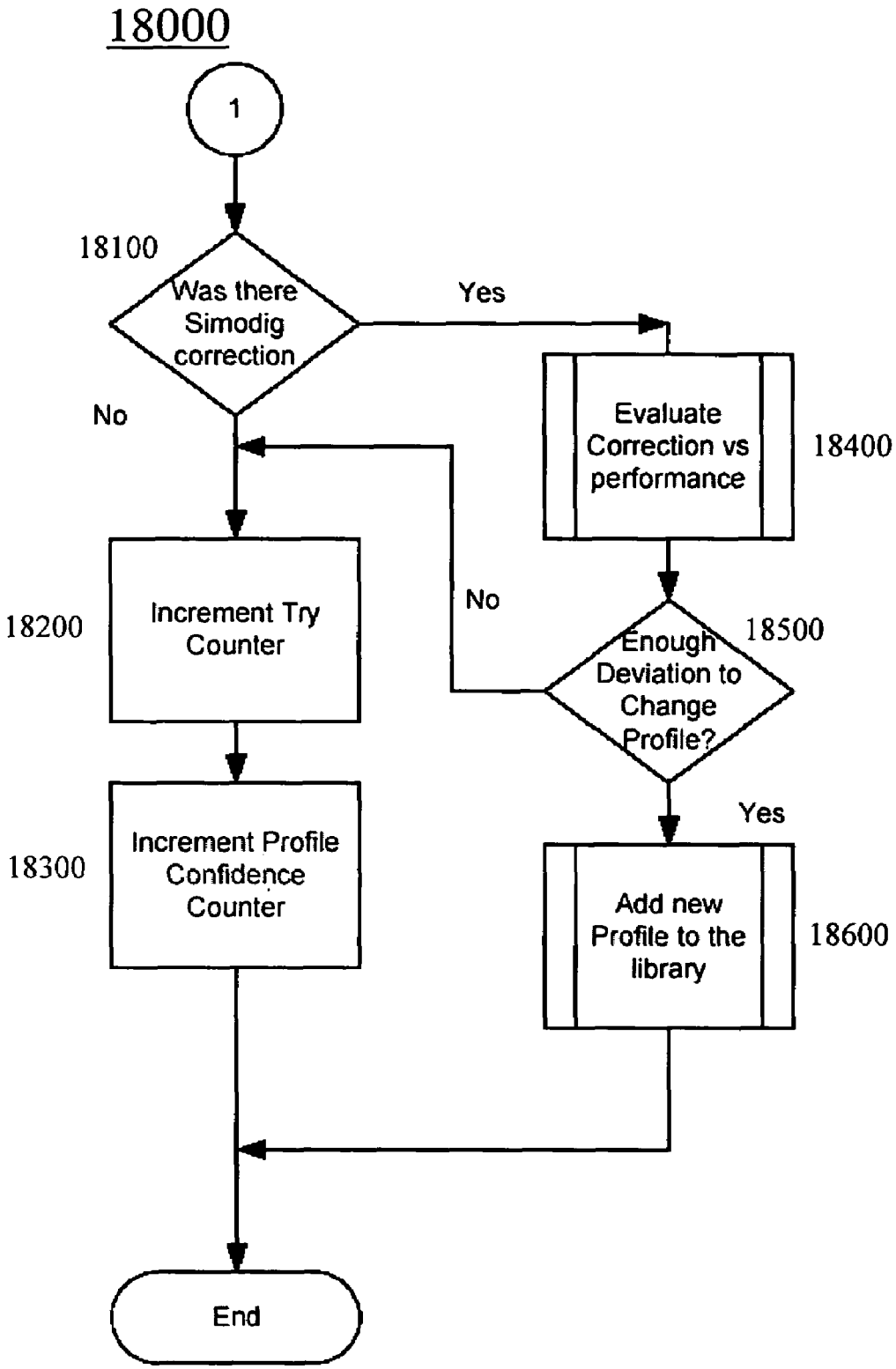
FIG. 18 is a flowchart of an exemplary embodiment of a method 18000 related to the method 17000.

FIG. 18 is a flowchart of an exemplary embodiment of a method 18000 related to the method 17000. At activity 18100, a determination can be made regarding whether a correction has been made to the Simodig procedure. If a correction has been made, at activity 18400, the correction as compared to performance can be evaluated. At activity 18500, a determination can be made whether a performance deviation is sufficiently large to change the profile and/or digging procedure. If the deviation is large enough, at activity 18600, a new profile can be added to the digging library and method 18000 can end.

If the deviation at activity 18500 is not sufficiently large, control can return to activity 18200. If there was no Simodig correction at activity 18100, at activity 18200, a try counter can be incremented. At activity 18300, a profile confidence counter can be incremented.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, such as via an explicit definition, there is no requirement for the inclusion in any claim herein (or of any claim of any application claiming priority hereto) of any particular described or illustrated characteristic, function, activity, or element, any particular sequence of activities, or any particular interrelationship of elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

What is claimed is:

1. A method for controlling an electric mining shovel, the method comprising a plurality of activities comprising:

determining a profile of a digging surface responsive to a scan of the digging surface;

identifying a predetermined bank profile from a plurality of predetermined bank profiles, the identified predetermined bank profile a closest match of the plurality of predetermined bank profiles to the profile of the digging surface;

automatically determining a first electric mining shovel digging procedure based upon the identified predetermined bank profile;

automatically executing an optimization routine to determine a second electric mining shovel digging procedure;

automatically comparing the first electric mining shovel digging procedure to the second electric mining shovel digging procedure to determine a preferred electric mining shovel digging procedure;

executing a confusion routine responsive to a determination that a bank of said digging surface is unstable, said confusion routine adapted to request at least partial operator control of said electric mining shovel; and automatically executing the preferred electric mining shovel digging procedure via the electric mining shovel, the preferred electric mining shovel digging procedure adapted to, responsive to an automatic relocation of the electric mining shovel, automatically control a cable reel to change an extended length of an electrical cable utilized to provide power to the electric mining shovel.

2. The method of claim 1, further comprising:

receiving a location of a mining haulage vehicle relative to the electric mining shovel; and automatically signaling said mining haulage vehicle to move to a determined position.

3. The method of claim 1, further comprising:

receiving a Global Position System (GPS) signal from a mining haulage vehicle, the GPS signal indicative of a location of the mining haul age vehicle relative to the electric mining shovel.

4. The method of claim 1, further comprising:

based upon the profile of the digging surface, determining a procedure for loading a mining haulage vehicle with the electric mining shovel, the profile of the digging surface analyzed via a neural network.

5. The method of claim 1, further comprising:

executing a procedure for loading a mining haulage vehicle, the loading procedure based upon the preferred digging procedure, the procedure for loading the mining haulage vehicle based upon the profile of the digging surface, the profile of the digging surface analyzed via a support vector machine.

6. The method of claim 1, further comprising:

optimizing a procedure for loading a mining haulage vehicle responsive to a result of a power optimization routine, the mining haulage vehicle to be loaded by the electric mining shovel, the procedure for loading the mining haulage vehicle based upon an optimum calculated dipper height used to position a dipper of the electric mining shovel, a rate of emptying of the bucket reduced responsive to a determination that no earthen material is present in a bed of the mining haulage vehicle.

7. The method of claim 1, further comprising:

responsive to a signal from a mining haulage vehicle, automatically transmitting instructions adapted to relocate the mining haulage vehicle.

8. The method of claim 1, further comprising:

signaling an operator to manually control the electric mining shovel responsive to a determination that a parameter related to control of the electric mining shovel is invalid.

9. The method of claim 1, further comprising:

based upon the profile of the digging surface, automatically detecting an interference of the electric mining shovel with an object, the profile of the digging surface analyzed via a decision tree.

10. The method of claim 1, further comprising:

automatically relocating the electric mining shovel responsive to detection of an interference of the electric mining shovel with an object.

11. The method of claim 1, further comprising:

relocating the electric mining shovel responsive to instructions to relocate the electric mining shovel.

12. The method of claim 1, further comprising:

automatically managing the electrical cable coupled to the electric mining shovel while relocating the electric mining shovel.

13. The method of claim 1, further comprising:

automatically detecting a fault in the electric mining shovel; and automatically scheduling maintenance on said electric mining shovel.

14. The method of claim 1, further comprising:

via automatically switching to one of a spare variable frequency drive or a spare programmable logic controller, automatically repairing a fault detected in the electric mining shovel.

15. The method of claim 1, further comprising:

automatically signaling a help entity responsive to a detected fault in the electric mining shovel.

16. The method of claim 1, further comprising:

based upon the profile of the digging surface, receiving instructions regarding the digging surface, the profile of the digging surface analyzed via an independent component analysis.

17. The method of claim 1, further comprising:

based upon the profile of the digging surface, receiving instructions regarding a boundary of a pocket of material to be removed by the electric mining shovel, the profile of the digging surface analyzed via a self-organized map.

18. The method of claim 1, further comprising:

modifying the first digging procedure responsive to a machine positional limit of the electric mining shovel.

19. The method of claim 1, further comprising:

scheduling a maintenance activity for the electric mining shovel responsive to a detected event.

20. A method for controlling an electric mining shovel, the method comprising a plurality of activities comprising:

determining a profile of a digging surface responsive to a scan of the digging surface;

via a Bayesian network, identifying a predetermined bank profile from a plurality of predetermined bank profiles, the identified predetermined bank profile a closest match of the plurality of predetermined bank profiles to the profile of the digging surface;

automatically determining a first electric mining shovel digging procedure based upon the identified predetermined bank profile;

automatically executing an optimization routine to determine a second electric mining shovel digging procedure;

automatically comparing the first electric mining shovel digging procedure to the second electric mining shovel digging procedure to determine a preferred electric mining shovel digging procedure;

executing a confusion routine responsive to a determination that a bank of said digging surface is unstable, said confusion routine adapted to request at least partial operator control of said electric mining shovel; and transferring the preferred electric mining shovel digging procedure via the electric mining shovel, the preferred electric mining shovel digging procedure adapted to, responsive to an automatic relocation of the electric mining shovel, automatically control a cable reel to change an extended length of an electrical cable utilized to provide power to the electric mining shovel.

21. A machine-readable medium having stored thereon a plurality of executable instructions adapted to control an electric mining shovel, the plurality of instructions comprising instructions to:

determine a profile of a digging surface responsive to a scan of the digging surface;

via a Gaussian process, identify a predetermined bank profile from a plurality of predetermined bank profiles, the identified predetermined bank profile a closest match of the plurality of predetermined bank profiles to the profile of the digging surface;

automatically determine a first electric mining shovel digging procedure based upon the identified predetermined bank profile;

automatically execute an optimization routine to determine a second electric mining shovel digging procedure;

automatically compare the first electric mining shovel digging procedure to the second electric mining shovel digging procedure to determine a preferred electric mining shovel digging procedure;

execute a confusion routine responsive to a determination that a bank of said digging surface is unstable, said confusion routine adapted to request at least partial operator control of said electric mining shovel; and automatically execute the preferred electric mining shovel digging procedure via the electric mining shovel, the preferred electric mining shovel digging procedure adapted to, responsive to an automatic relocation of the electric mining shovel, automatically control a cable reel to change an extended length of an electrical cable utilized to provide power to the electric mining shovel.

22. The method of claim 1, further comprising:

executing a confusion routine responsive to a determination that a bank of said digging surface is unstable, said confusion routine adapted to request at least partial manual operator control of said electric mining shovel.

* * * * *